US012790103B2

(12) United States Patent
Parikh et al.

(10) Patent No.: US 12,790,103 B2
(45) Date of Patent: Nov. 10, 2026

(54) CONTAINER FOR FOOD ITEMS

(71) Applicant: GIVE AND GO PREPARED FOODS CORP., Etobicoke (CA)

(72) Inventors: Samir R. Parikh, Brampton (CA); Doug Brummer, Toronto (CA)

(73) Assignee: GIVE AND GO PREPARED FOODS CORP., Etobicoke (CA)

( * ) Notice: Subject to any disclaimer, the term of this patent is extended or adjusted under 35 U.S.C. 154(b) by 0 days.

(21) Appl. No.: 18/667,422

(22) Filed: May 17, 2024

(65) Prior Publication Data

US 2024/0300727 A1 Sep. 12, 2024

Related U.S. Application Data

(63) Continuation of application No. 16/902,841, filed on Jun. 16, 2020, now abandoned, which is a (Continued)

(51) Int. Cl.
*B65D 85/36* (2006.01)
*B65B 7/26* (2006.01)
(Continued)

(52) U.S. Cl.
CPC ..... *B65D 85/36* (2013.01); *B65B 7/26* (2013.01); *B65B 25/001* (2013.01); *B65D 1/24* (2013.01);
(Continued)

(58) Field of Classification Search
CPC . B65D 85/36; B65D 1/24; B65D 1/36; B65D 43/162; B65D 43/22; B65D 65/02; B65D 77/02; B65D 81/05; B65D 85/60; B65D 2543/00194; B65D 2543/00203; B65D 2543/00296; B65D 2543/00361; B65D 2543/0049; B65D 2543/00509; B65D 2543/00537; B65D 2543/00555;
(Continued)

(56) References Cited

U.S. PATENT DOCUMENTS 1,607,024 A 11/1926 Thomson
2,100,516 A 11/1937 Read
(Continued)

FOREIGN PATENT DOCUMENTS

EP 1538102 A1 6/2005
EP 1538102 B1 6/2009
GB 2519328 A * 4/2015 ..... B65D 1/36

*Primary Examiner* — Drew E Becker
(74) *Attorney, Agent, or Firm* — SMART & BIGGAR LP; James Raakman

(57) ABSTRACT

A method of providing packaged food items on display in a retail store includes preparing a plurality of edible body portions of respective food items in a preparation facility, and loading the food items in a container. The container has a lid with at least one protrusion extending downward from a lid upper surface. After applying an edible decorating product to a decoration portion of an upper surface of the edible body portion of each food item, the lid is closed, thereby bringing respective retainers of the protrusion into abutment with undecorated marginal portions of the upper surface of the edible body portions of each food item. The container is then placed for display on a sales shelf in the retail store.

20 Claims, 13 Drawing Sheets

Related U.S. Application Data continuation of application No. 15/454,728, filed on Mar. 9, 2017, now abandoned, which is a continuation of application No. 13/464,469, filed on May 4, 2012, now Pat. No. 9,592,951.

(60) Provisional application No. 61/482,376, filed on May 4, 2011.

(51) Int. Cl.

| | |
|---|---|
| ***B65B 25/00*** | (2006.01) |
| ***B65D 1/24*** | (2006.01) |
| ***B65D 1/36*** | (2006.01) |
| ***B65D 43/16*** | (2006.01) |
| ***B65D 43/22*** | (2006.01) |
| ***B65D 65/02*** | (2006.01) |
| ***B65D 77/02*** | (2006.01) |
| ***B65D 81/05*** | (2006.01) |
| ***B65D 85/60*** | (2006.01) |

(52) U.S. Cl.

CPC ..... *B65D 1/36* (2013.01); *B65D 43/162* (2013.01); *B65D 43/22* (2013.01); *B65D 65/02* (2013.01); *B65D 77/02* (2013.01); *B65D 81/05* (2013.01); *B65D 85/60* (2013.01); *B65D 2543/00194* (2013.01); *B65D 2543/00203* (2013.01); *B65D 2543/00296* (2013.01); *B65D 2543/00361* (2013.01); *B65D 2543/0049* (2013.01); *B65D 2543/00509* (2013.01); *B65D 2543/00537* (2013.01); *B65D 2543/00555* (2013.01); *B65D 2543/0062* (2013.01); *B65D 2543/00694* (2013.01); *B65D 2543/00731* (2013.01); *B65D 2543/00805* (2013.01); *B65D 2543/00842* (2013.01); *B65D 2585/363* (2013.01)

(58) Field of Classification Search

CPC .. B65D 2543/0062; B65D 2543/00694; B65D 2543/00731; B65D 2543/00805; B65D 2543/00842; B65D 2585/363; B65B 7/26; B65B 25/001

See application file for complete search history.

(56) References Cited

U.S. PATENT DOCUMENTS

| | | | | |
|---|---|---|---|---|
| 3,845,875 | A | 11/1974 | Douglas et al. | |
| 3,865,953 | A | 2/1975 | Peters | |
| 4,002,773 | A | 1/1977 | Entenmann | |
| 4,205,777 | A | 6/1980 | Brown et al. | |
| 4,415,601 | A | 11/1983 | Eckel et al. | |
| 4,472,440 | A | 9/1984 | Bank | |
| 5,632,924 | A | 5/1997 | Gics et al. | |
| 5,858,428 | A | 1/1999 | Truscello et al. | |
| 6,033,699 | A | 3/2000 | Vincenzi | |
| 6,176,375 | B1 | 1/2001 | Truscello et al. | |
| 6,231,906 | B1 * | 5/2001 | Alessi | B65D 43/162 426/106 |
| 6,896,140 | B1 | 5/2005 | Perry | |
| D514,452 | S | 2/2006 | Enriquez | |
| D592,076 | S | 5/2009 | Sipe et al. | |
| D592,077 | S | 5/2009 | Sipe et al. | |
| 8,727,121 | B2 | 5/2014 | Parikh et al. | |
| 8,895,091 | B2 | 11/2014 | Boyer | |
| 9,592,951 | B2 | 3/2017 | Brummer et al. | |
| D792,240 | S | 7/2017 | Sellari et al. | |
| 2004/0251162 | A1 | 12/2004 | McGinnis et al. | |
| 2005/0029258 | A1 | 2/2005 | Juliano et al. | |
| 2005/0284307 | A1 | 12/2005 | Vovan | |
| 2007/0102437 | A1 | 5/2007 | Griswold | |
| 2009/0218347 | A1 | 9/2009 | Helou, Jr. | |
| 2009/0223966 | A1 | 9/2009 | Kidd et al. | |
| 2009/0242569 | A1 | 10/2009 | Solmon | |
| 2010/0018969 | A1 | 1/2010 | Marks et al. | |
| 2010/0147730 | A1 | 6/2010 | Archambault et al. | |
| 2010/0308039 | A1 | 12/2010 | Miros et al. | |
| 2011/0031375 | A1 | 2/2011 | Powell | |
| 2011/0212227 | A1 | 9/2011 | Verschelden | |
| 2011/0226663 | A1 | 9/2011 | Bushell et al. | |
| 2013/0199959 | A1 | 8/2013 | Parikh et al. | |
| 2013/0327777 | A1 * | 12/2013 | Boyer | B65D 25/10 220/573.1 |
| 2016/0325900 | A1 * | 11/2016 | Stone | B65D 75/324 |
| 2019/0055082 | A1 * | 2/2019 | Guirguis | B65D 51/245 |
| 2019/0241354 | A1 * | 8/2019 | Corbin | B65D 85/36 |
| 2019/0352039 | A1 | 11/2019 | Lane | |
| 2020/0377266 | A1 * | 12/2020 | Lotfi | B65D 85/60 |
| 2025/0333214 | A1 * | 10/2025 | Stirmel | B65D 1/36 |
| 2026/0048902 | A1 * | 2/2026 | Parikh | B65D 1/36 |
| 2026/0048903 | A1 * | 2/2026 | Parikh | B65D 1/36 |

* cited by examiner

CONTAINER FOR FOOD ITEMS

RELATED APPLICATIONS

This application is a continuation of U.S. patent application Ser. No. 16/902,841, filed Jun. 16, 2020, which is a continuation of U.S. patent application Ser. No. 15/454,728, filed Mar. 9, 2017, which is a continuation of U.S. patent application Ser. No. 13/464,469, filed May 4, 2012, which claims the benefit of U.S. Provisional Application Ser. No. 61/482,376, filed May 4, 2011, each of which is hereby incorporated herein by reference.

FIELD

The teachings herein relate to food containers and methods for preparing, storing and/or transporting food items.

INTRODUCTION

U.S. Pat. No. 6,231,906 (Alessi) discloses a packaging system for tart shells that includes transparent lower and upper halves connected together and lockable together by protrusions and recesses in the halves. The upper and lower halves have one or more chambers defined by chamber halves formed in the lower and upper halves that combine together to form each chamber. In the preferred embodiments, anywhere from one to eight chambers may be provided in the packaging system. Concerning each such chamber, the lower half of the packaging system includes a recess sized and configured to receive the undersurface of a tart shell. The upper chamber half includes a generally dome-shaped portion designed to overlie a recess within the tart shell that is normally filled with an edible material and has a lower periphery spaced radially inwardly from the lower periphery of the lower chamber half. Radially outwardly from the lower periphery of the dome-shaped portions, a ledge is formed that overlies the outer periphery of the lower chamber half. This ledge is sized and configured to capture the periphery of a tart shell contained within the chamber and prevents movement of the tart shell out of snug engagement with the lower chamber half.

U.S. Patent Application Publication No. 2009/0242569 (Solmon) discloses a food product package capable of stabilizing a food product being stored therein. The food product package may include a base, a cover and an insert. The cover may be fastened to the base and the insert may be disposed between the base and the cover. A body of the base may include at least one pocket adapted to hold a food product, such as a cupcake. The insert may be positioned onto the base such that an edge portion of the insert may contact the food product. When the cover is fastened to the base, a portion of the cover may press the insert against the base to thereby securely hold the food product in place.

U.S. Pat. No. 6,176,375 (Truscell et al.) discloses a container that has a hollow base and a cap to store a filled food product having an edible shell with a peripheral flange. The base has a top member with an opening, a bottom member and an upstanding wall member that connects the top and bottom members. The opening in the top member and the upstanding wall member are dimensioned such that the shell is capable of being partially contained within and supported by the base while the flange of the shell is vertically spaced above the uppermost part of the base. The cap is connected to the base to enclose the filled food product. The cap is dimensioned and configured such that, when the filled food product is positioned in the base and the cap is connected to the based to enclose the food product, a middle portion of the cap engages the flange and projects downwardly therefrom, and a lower portion of the cap closes the cap to the base such that the cap presses the filled food product to the base. The container thereby prevents movement of the filled food product relative to the base, while the flange is vertically spaced above the uppermost part of the base to enable the filled food product to be gripped by the flange for easy removal from the base.

SUMMARY

This summary is intended to introduce the reader to various aspects of the applicant's teaching, but not to define any invention. In general, disclosed herein are one or more containers and methods using the containers to store and transport food items, including decorated food items.

In accordance with some aspects of the teaching disclosed herein, a method of providing packaged food items on display in a retail store includes: (a) preparing a plurality of edible body portions of respective food items in a preparation facility, the plurality of edible body portions including a first edible body portion of a first food item and a second edible body portion of a second food item; (b) after step (a), loading each of the food items into respective cavities of a container, the container having a lid with a substantially planar upper lid surface covering the cavities when the lid is closed and at least one protrusion extending downward from the upper lid surface, the protrusion having at least a first retainer and a second retainer extending laterally outwardly from a distal end of the protrusion; (c) after step (a), decorating the first edible body portion with a first edible decorating product applied to a first decoration portion on a first upper surface of the first edible body portion and leaving a first marginal portion of the first upper surface adjacent the first decoration portion free of decoration, and decorating the second edible body portion with a second edible decorating product applied to a second decoration portion on a second upper surface of the second edible body portion and leaving a second marginal portion of the second upper surface adjacent the second decoration portion free of decoration; (d) after step (c), closing the lid, wherein closing the lid moves the first retainer to abut the first marginal portion of the first upper surface of the first edible body portion of the first food item in the container, and moves the second retainer to abut the second marginal portion of the upper surface of the second edible body portion of the second food item in the container; and (e) after step (d), placing the container for display on a sales shelf in the retail store.

In some examples, the method includes, after steps (a) and (b) and before step (d), freezing the food items. In some examples, the method includes before said placing step and after said freezing step, thawing the food items.

In some examples, the preparing step (a) includes dispensing batter into a plurality of wrappers disposed on a baking pan, and baking the batter to form the edible body portions of baked batter. Each of the first upper surface and the second upper surface is formed by a top surface of the baked batter in a respective one of the wrappers. Each top surface extends across an upper end of the respective edible body portion, and each edible body portion has a side surface of baked batter extending downward from the upper surface. At least a portion of the side surface of each edible body portion has the respective wrapper removably bonded thereto. In some examples, the loading step (b) includes removing the edible body portions from the baking pan.

According to some aspects of the teaching disclosed herein, a method of packaging decorated food items in a visually appealing manner includes: (a) nesting first, second, third, and fourth food items in respective first, second, third, and fourth cavities in a base of a container, the cavities arranged in a two-by-two pattern, each food item including a respective edible body portion having an upper surface directed away from the base; (b) prior to at least step (c), providing a decorated section on the upper surface of the edible body portion of each of the first, second, third, and fourth food items by applying an edible decorating product thereon, each decorated section at least partially bounded by an undecorated marginal portion of the upper surface of the edible body portion of each respective food item; and (c) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for abutting respective locations along the undecorated marginal portions of the edible body portions of the first, second, third, and fourth food items, respectively, to limit displacement of the food items out of the cavities.

In some examples, the upper lid surface, the lid sidewall, and the retaining protrusion are integrally formed of a transparent plastic material. In some examples, the first, second, third and fourth protrusion retainers abut the respective locations of the undecorated marginal portions of the edible body portions of the first, second, third, and fourth food items generally constantly when the food items are in the cavities and the lid is closed, to inhibit the decorated sections from contacting an inner surface of the lid.

In some examples, the first, second, third, and fourth protrusion retainers abut the respective portions of the undecorated marginal portions of the first, second, third, and fourth food items only when the food items are urged upwards towards the closed lid during handling of the container, to inhibit the decorated sections from contacting an inner surface of the lid.

According to some aspects of the teaching disclosed herein, a method of packaging decorated food items in a visually appealing manner includes: (a) nesting first, second, third, and fourth food items in respective first, second, third, and fourth cavities in a base of a container, the cavities arranged in a two-by-two pattern, each food item including an edible body portion having an upper surface directed away from the base; (b) prior to at least step c), providing a decorated section on the upper surface of the edible body portion of each food item by applying an edible decorating product thereon, each decorated section at least partially bounded by an undecorated marginal portion of the respective edible body portion; and (c) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for abutting respective locations of the undecorated marginal portions of the first, second, third, and fourth food items, respectively, to limit displacement of the food items out of the cavities. The closing step moves the first, second, third, and fourth retainers to respective positions protruding laterally inwardly of respective first, second, third, and fourth cavity rims at upper ends of the first, second, third, and fourth cavities.

In some examples, the lid, including the upper lid surface, the lid sidewall, and the retaining protrusion, and the base, including the cavities and the cavity rims, are integrally formed of a transparent plastic material. In some examples, the lid and base are connected to each other by a living hinge, and closing the lid onto the base includes pivoting the lid about the living hinge.

According to some aspects of the teaching disclosed herein, a method of packaging decorated food items includes: (a) nesting first, second, third, and fourth food items in respective first, second, third, and fourth cavities in a base of a container, the cavities arranged in a two-by-two pattern, each food item including an edible body portion with an upper surface, the upper surface including a decorated section at least partially bounded by an undecorated marginal portion of the upper surface of the edible body portion; and (b) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for overlying respective locations of the undecorated marginal portions of the upper surface of the edible body portions of the first, second, third, and fourth food items, respectively, to limit displacement of the food items out of the cavities.

In some examples, when nested in the respective cavities and with the lid closed, a gap of limited vertical extent is provided between the respective protrusion retainers and the respective locations of the undecorated marginal portions of the upper surfaces of the edible body portions of the respective food items so that the displacement of the food items out of the cavities is limited to about the vertical extent of the gap.

In some examples, an outer side surface of the edible body portion of each food item is wrapped at least in part by a paper wrapper.

In some examples, the method includes prior to step (a), preparing the first, second, third, and fourth food items by dispensing batter in first, second, third, and fourth removable wrappers disposed on a baking pan, and then baking the batter to form the edible body portions of baked batter, wherein the upper surface of the edible body portion of each food item is formed by a top surface of the baked batter in each respective wrapper. In some examples, the undecorated marginal portion of the upper surface of the edible body portion of each food item includes an undecorated surface portion of the top surface of the baked batter of the respective food item. In some examples, each respective edible body portion of each food item has a side surface of baked batter extending downward from the top surface, and wherein each wrapper has a wrapper inner surface removably bonded to a portion of the side surface of each respective body portion. In some examples, each wrapper has a wrapper outer surface opposite the wrapper inner surface, each wrapper outer surface bearing against a cavity inner surface of the respective cavity and freely slidable axially relative to the cavity inner surface when each respective food item is nested in the respective cavity to facilitate removal of the food item from the container by a consumer.

In some examples, the step of closing the lid moves: (i) the first protrusion retainer into a first retaining position abutting a first undecorated surface portion of a first top surface of the baked batter of the first food item; and (ii) the second protrusion retainer into a second retaining position abutting a second undecorated surface portion of a second top surface of the baked batter of the second food item; and (iii) the third protrusion retainer into a third retaining position abutting a third undecorated surface portion of a third top surface of the baked batter of the third food item; and (iv) the fourth protrusion retainer into a fourth retaining position abutting a fourth undecorated surface portion of a fourth top surface of the baked batter of the fourth food item.

In some examples, axial movement of the first food item in a direction from the nested position toward the lid is limited by contact of the first protrusion retainer with the first undecorated surface portion of the baked batter of the first food item; axial movement of the second food item in a direction from the nested position toward the lid is limited by contact of the second protrusion retainer with the second undecorated surface portion of the baked batter of the second food item; axial movement of the third food item in a direction from the nested position toward the lid is limited by contact of the third protrusion retainer with the third undecorated surface portion of the baked batter of the third food item; and axial movement of the fourth food item in a direction from the nested position toward the lid is limited by contact of the fourth protrusion retainer with the fourth undecorated surface portion of the baked batter of the fourth food item.

DRAWINGS

The drawings included herewith are for illustrating various examples of containers that include one or more aspects of the teaching of the present specification and are not intended to limit the scope of what is taught in any way. In the drawings.

Figure 12:
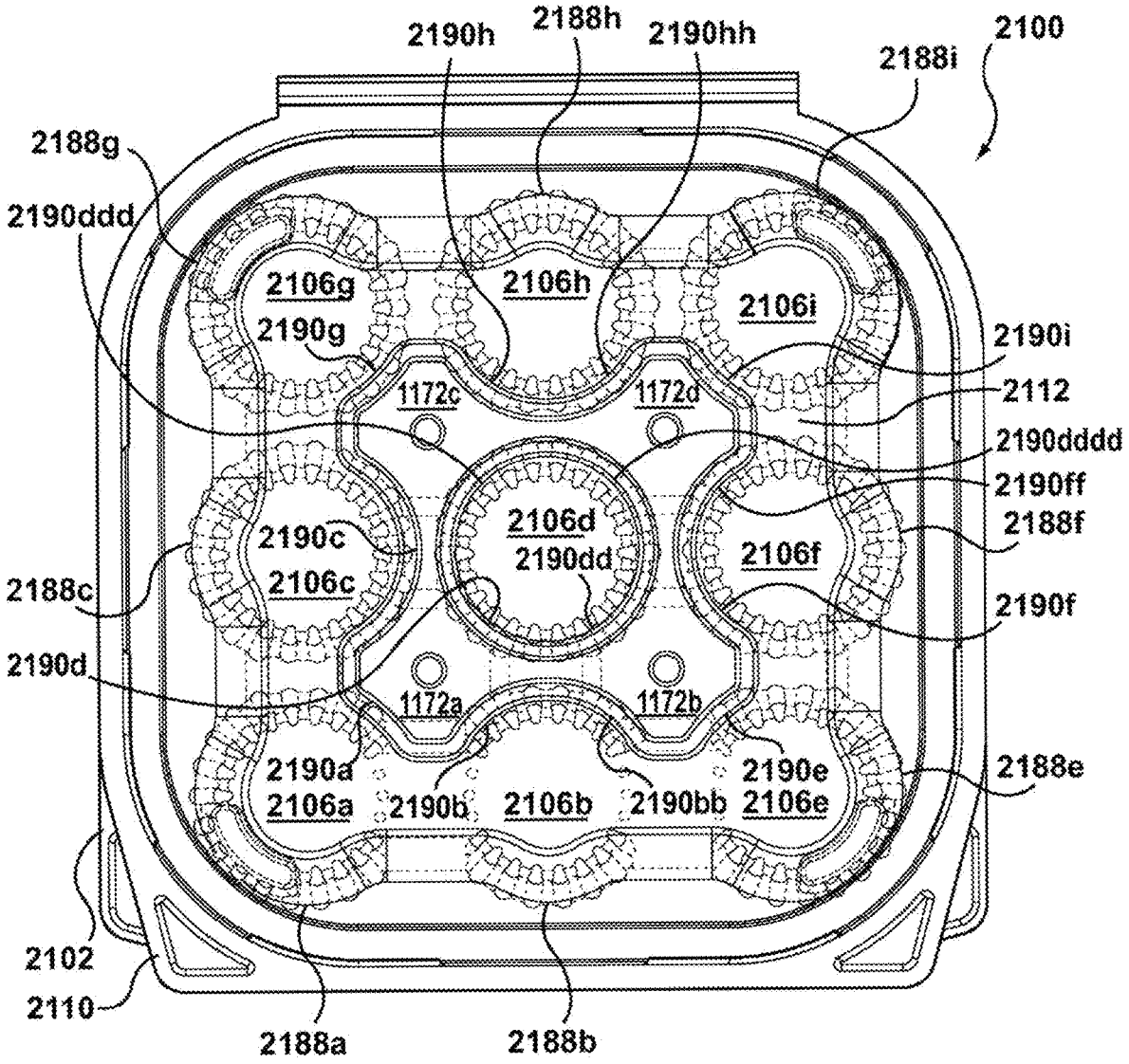
FIG. 12 is a top plan view of another example of a container, with its lid in a closed position.
Figure 13:
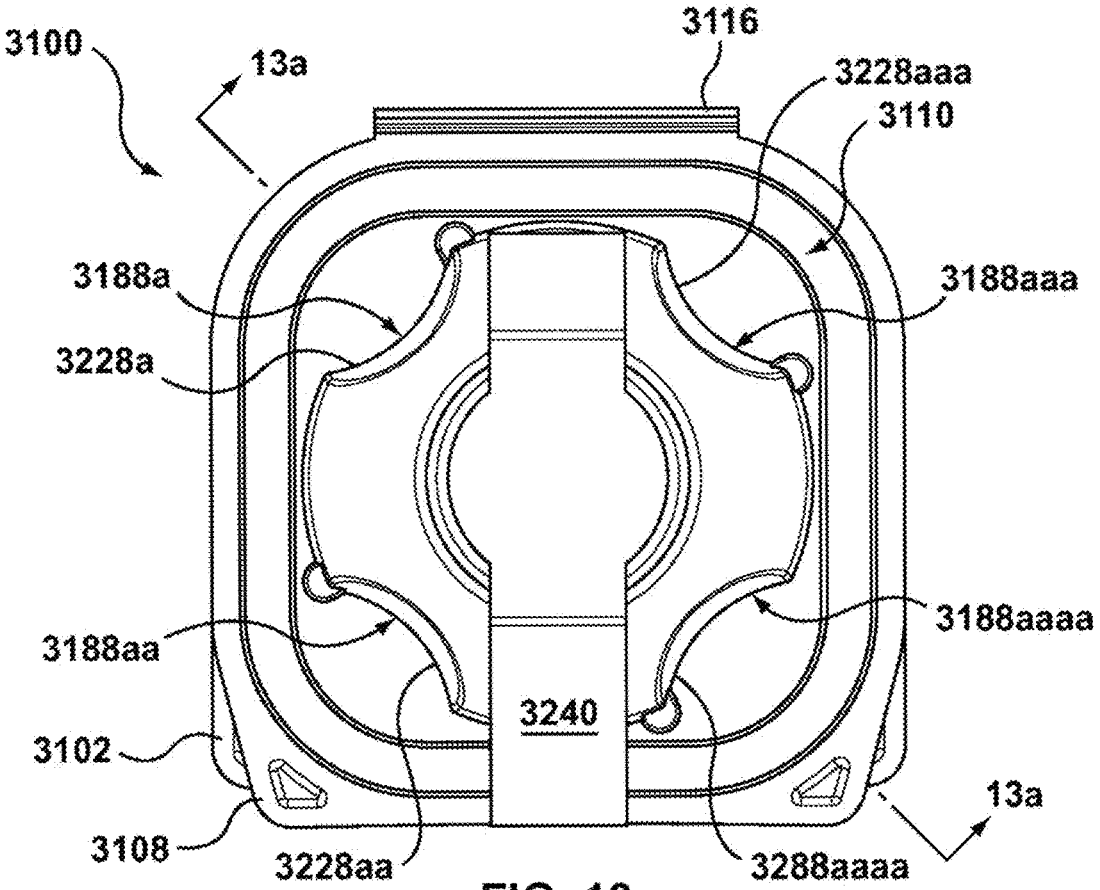
FIG. 13 is a top view of another example of a container.
Figure 14:
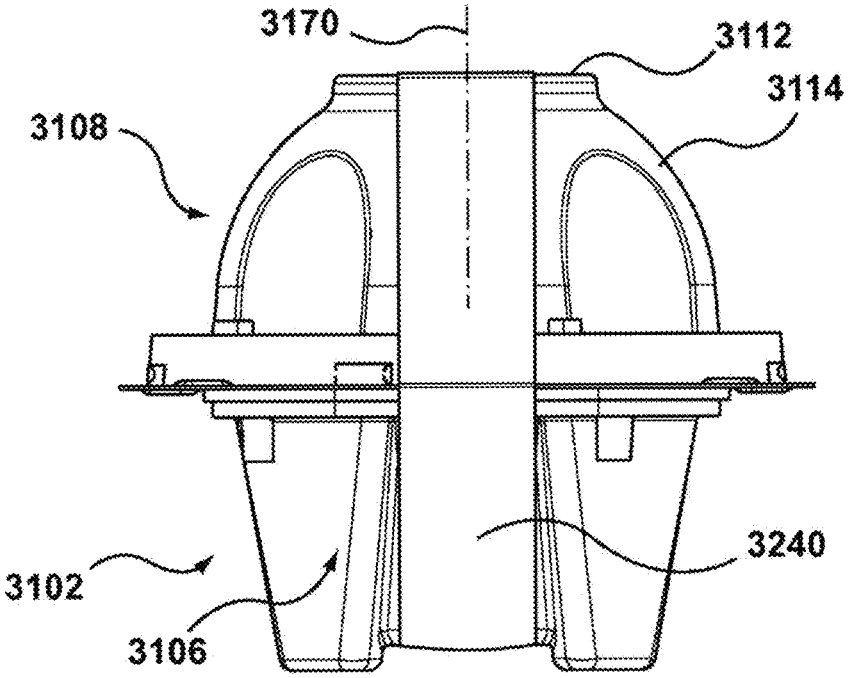
Figure 13A:
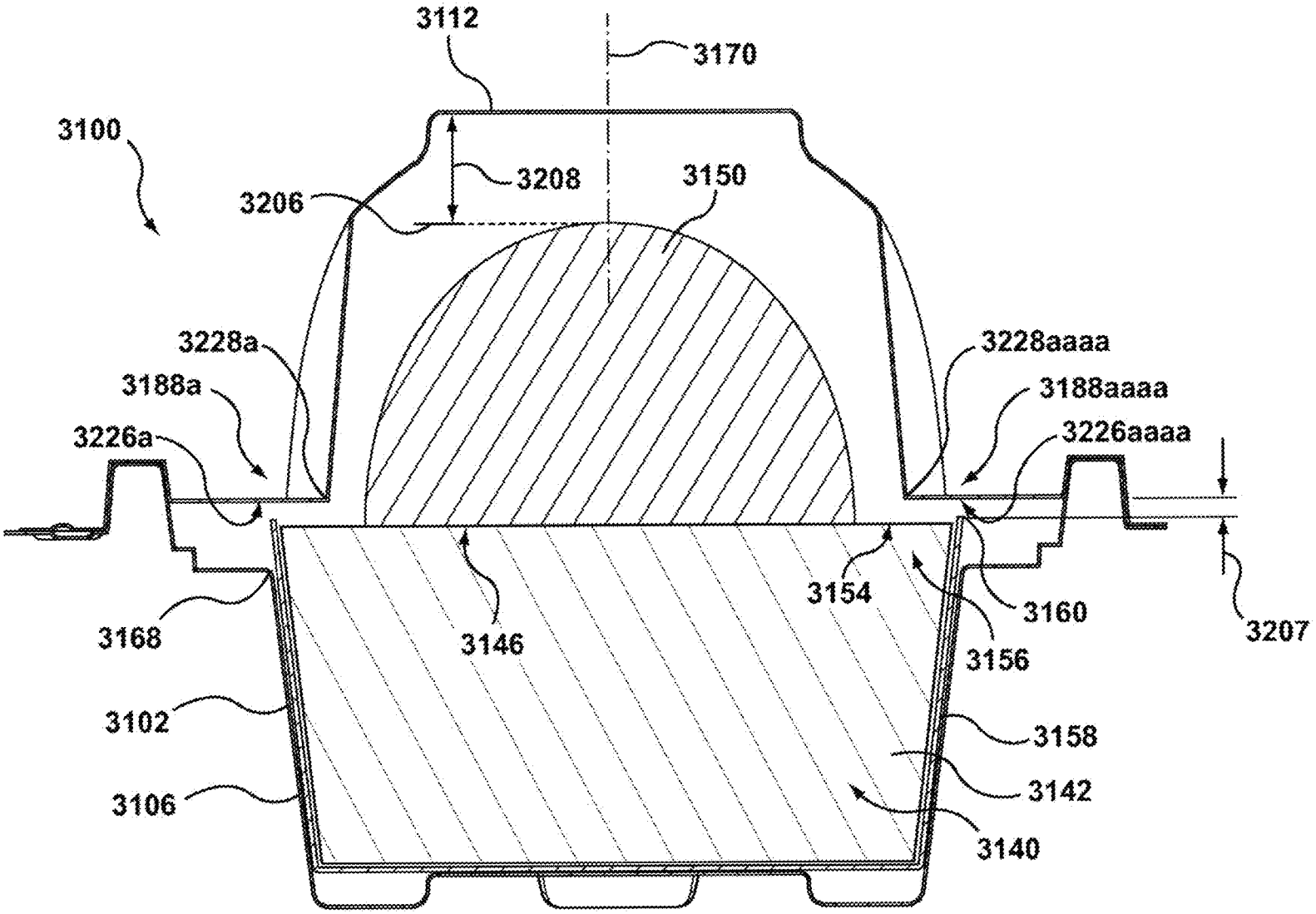

FIG. 13*a* is a sectional view of the container of FIG. 13, taken along line 13*a*-13*a* in FIG. 13;

FIG. 14 is a front view of the container of FIG. 12; and

Figure 15:
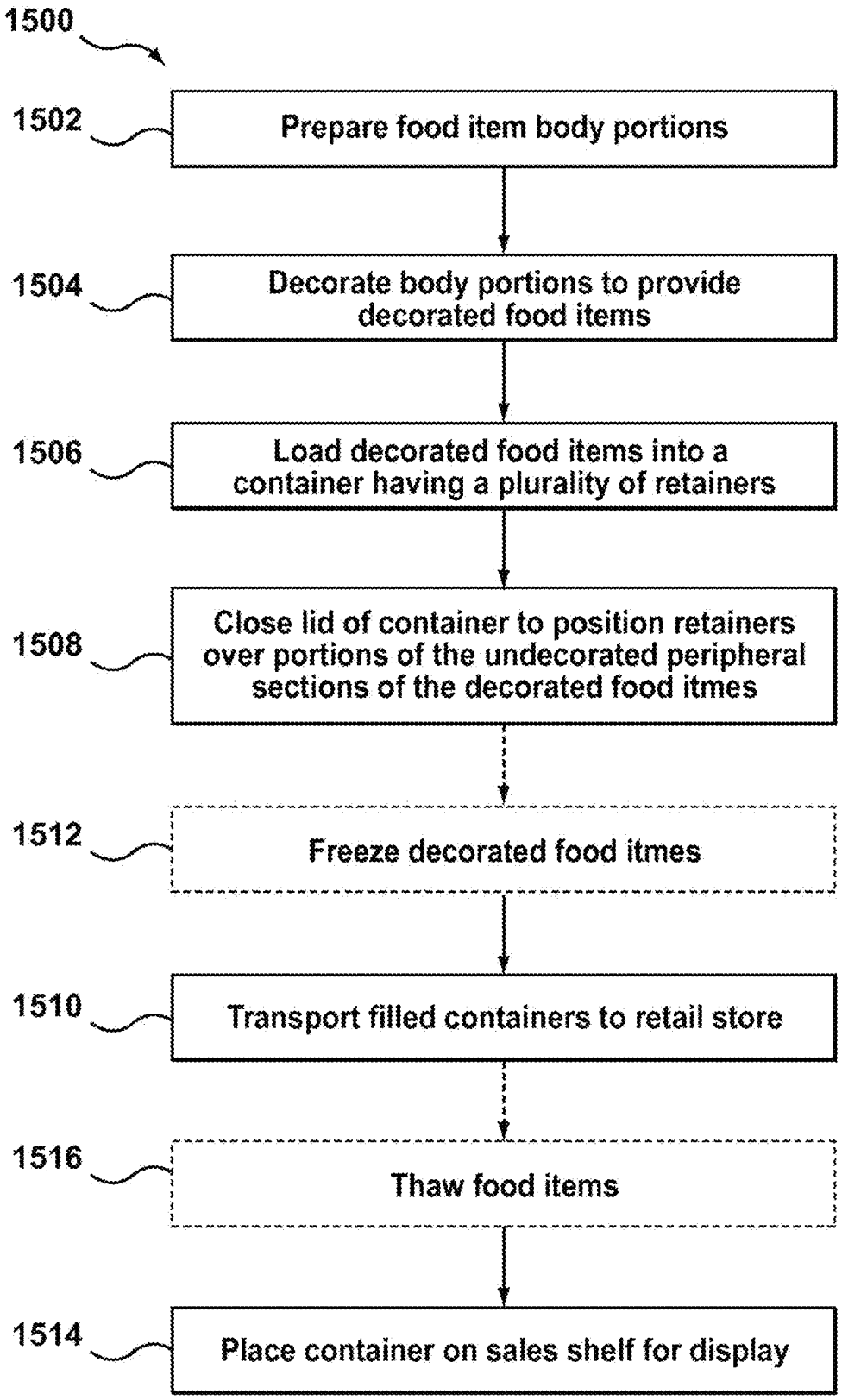

FIG. 15 is a flow chart illustrating a method of providing packaged decorated food items for display in a retail store.

DETAILED DESCRIPTION

Various apparatuses, and/or methods will be described below to provide an example of an embodiment of the invention. No embodiment described below limits any claimed invention and any claimed invention may cover apparatuses or methods that differ from those described below. The claimed inventions are not limited to apparatuses or methods having all of the features of any one apparatus or method described below or to features common to multiple or all of the apparatuses described below. It is possible that an apparatus or method described below is not an embodiment of any claimed invention. Any invention disclosed in an apparatus or method described below that is not claimed in this document may be the subject matter of another protective instrument, for example, a continuing patent application, and the applicants, inventors or owners do not intend to abandon, disclaim or dedicate to the public any such invention by its disclosure in this document.

Containers for storing or transporting food items can include a base and an openable lid. The lid and base can be sealingly connectable to each other when the lid is in the closed position to help maintain the freshness of the food items in the container. The lid can be removable from the base (to an open position) to allow a user to open the container and access the food items.

The base of the container can include a plurality of cavities for holding the food items. For example, if the food items are cupcakes, the base of a container can include a plurality of cavities that are configured to snugly receive at least a portion of the cupcakes, for example the baked, body portion of the cupcake.

After each cupcake is prepared and decorated it can be placed within a respective cavity in a container. Nesting each cupcake (or other food item) within a respective cavity can help retain the cupcake in two, lateral directions, for example the "x" and "y" directions or the left-right and forward-backward directions. Nesting the cupcakes in this manner may help prevent the cupcakes from shifting laterally relative to the container base when the container is transported, for example when carried in a delivery truck. Preventing lateral movement of the cupcakes may help prevent neighbouring cupcakes from sliding and contacting each other or the sides of the container. Contact between adjacent cupcakes or between the cupcakes and the container may damage the cupcakes. Such contact may also disturb or damage any frosting or other decorations provided on top of the cup cake.

While nesting the cupcakes in individual cavities may help reduce lateral movement, in some instances it may not be sufficient to inhibit vertical movement of the cupcakes relative to the container. For example, with some containers known in the prior art, jostling or shaking of the container (for example, when loaded on a delivery truck traveling along a bumpy road), cupcakes (or other food items) loaded in the container may shift vertically, i.e. in the "z" direction, relative to the container. Containers may also be inverted in the retail store by a customer inspecting the container, during the purchasing and/or checkout process, and/or at other times. Such vertical shifts may cause portions of the cupcakes, particularly the upper, decorated or frosted portions, to contact an upper portion of the container (for example the inner surface of the lid). Such contact may be generally undesirable for several reasons, including because it can ruin the aesthetic appeal of the decoration, can cause unsightly sticking of the decoration material to the inner surface of the lid, and can leave a consumer of the cupcake without the enjoyment of eating the icing or other decoration portion of the cupcake. The Applicant has discovered that providing retainers in the container may help inhibit vertical movement of a cupcake relative to its cavity. That is, when the container is tilted and/or inverted, axial or vertical movement of the cupcakes relative to their respective cavities may be limited by contact between the container's retainers and some portion of the food item. Optionally, the retainers and cupcake can be configured so that the retainers will contact undecorated portions of the cupcake, for example the undecorated peripheral section of the cupcake that surrounds the central decorated section, without contacting the decorated section or otherwise contacting the frosting.

Inhibiting the vertical or axial movement of the cupcakes relative to their respective cavities may help secure the cupcakes within their cavities and may help prevent unwanted contact between the cupcakes, particularly the decorated portions of the cupcakes, and the container lid (or other portions of the container, or other food items).

When using known food containers, one method of preventing damage to the frosting or other decorative portions of a food item, such as a cupcake, is to provide the cupcakes in an undecorated state (i.e. having no frosting or decoration that can be damaged during shipping) at a desired retail store. The undecorated food items (also called 'blanks') can be produced (e.g. baked) on-site at the store, or they can be produced off-site and shipped in an undecorated state to the store. However, if decorated cupcakes are desired, an in-store decorator employee is generally required. In some circumstances it may not be feasible or desirable to provide an in-store decorator in each retail store. The Applicant has discovered that it may be advantageous to decorate the cupcakes at a preparation facility before they are delivered to a retail grocery store, and then ship the cupcakes in a decorated state. For example, the cupcakes can be decorated at their manufacturing location (where the blanks are produced), or optionally at another intermediate location, such as a decorating facility. Decorating the blanks in a higher volume, mass-production facility may justify the investment of using automated equipment to apply the decorating. Utilizing automated decorating equipment may increase consistency of the decoration, allow for greater flexibility and complexity of the decoration being applied, and may reduce labour costs, particularly at the retail store level.

One method of providing packaged decorated food articles, for example cupcakes, for display and sale in a retail store can include the step of preparing a plurality of blanks (e.g. cupcake body portions) in a preparation facility. The cupcake bodies can then be decorated with a decoration portion (e.g. frosting, etc.) on an upper surface of the blank. After the cupcakes are decorated they can be loaded into respective cavities of a container. Optionally, the container can be a container having a lid with at least one protrusion that has at least a first retainer and a second retainer extending laterally outwardly from a distal end of the protrusion, as described in more detail below. The container lid can then be closed. If the container contains at least two cupcakes, closing the lid can move the first retainer to engage a first marginal portion of a first upper surface of a first cupcake in the container. Closing the lid can also move the second retainer to engage a second marginal portion of a second upper surface of a second cupcake in the container. A user can then transport the container away from the preparation facility for indirect or direct delivery to the retail store.

Optionally, the decorated food articles can be frozen prior to being shipped (i.e. at the preparation facility). Containers containing a plurality of frozen decorated cupcakes can then be displayed in-store in their frozen state (e.g. in a grocer's freezer section). Alternatively, the decorated cupcakes can be thawed prior to being displayed in-store.

Figure 1:
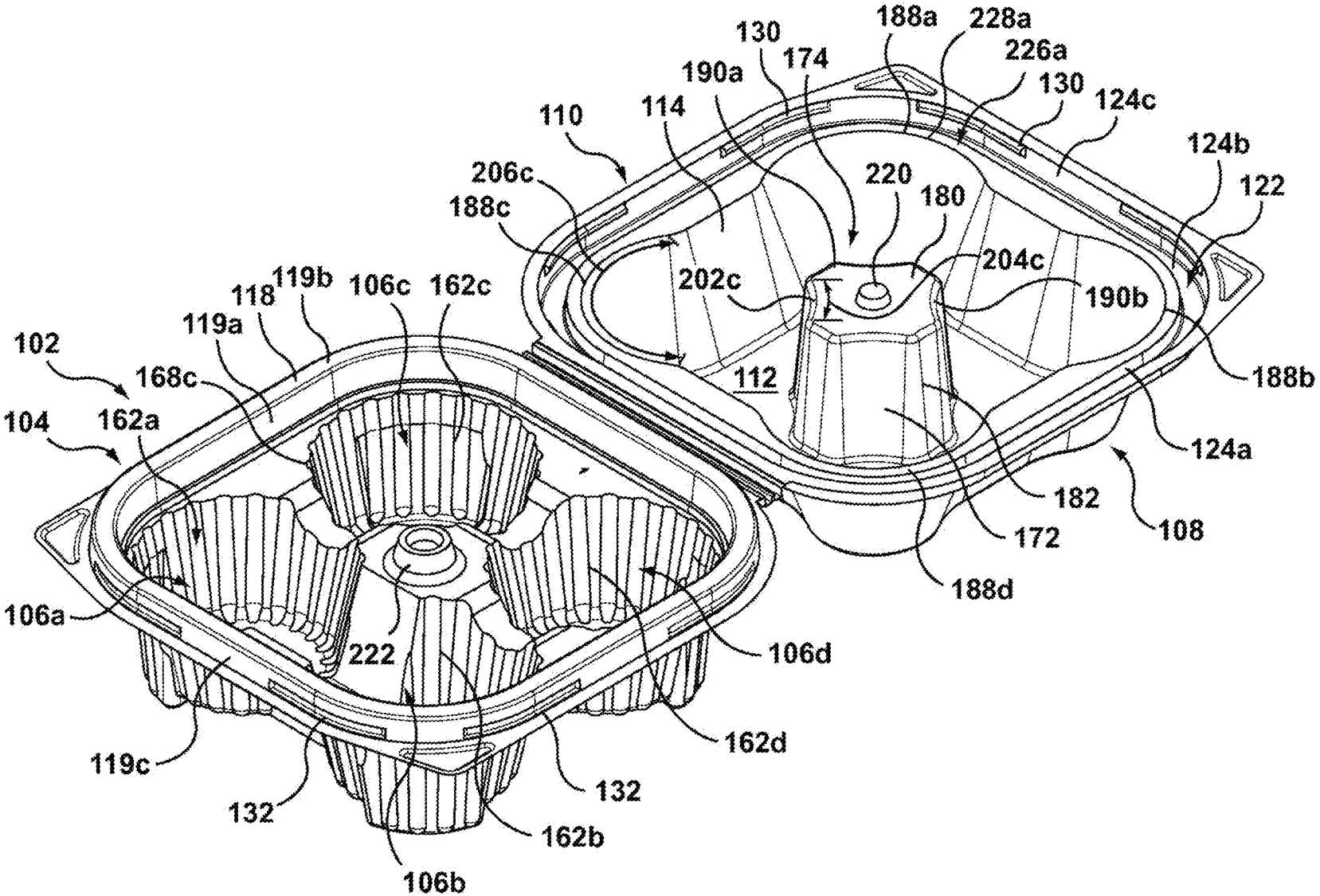
FIG. 1 is a perspective view of a container with its lid in an open position.

Referring to FIGS. 1, a container 100 includes a base 102 having a base peripheral edge 104, a plurality of cavities 106 (including cavities 106*a*, 106*b*, 106*c* and 106*d*) in the base 102. The container 100 can be configured to store, display and/or transport a plurality of food items.

Figure 2:
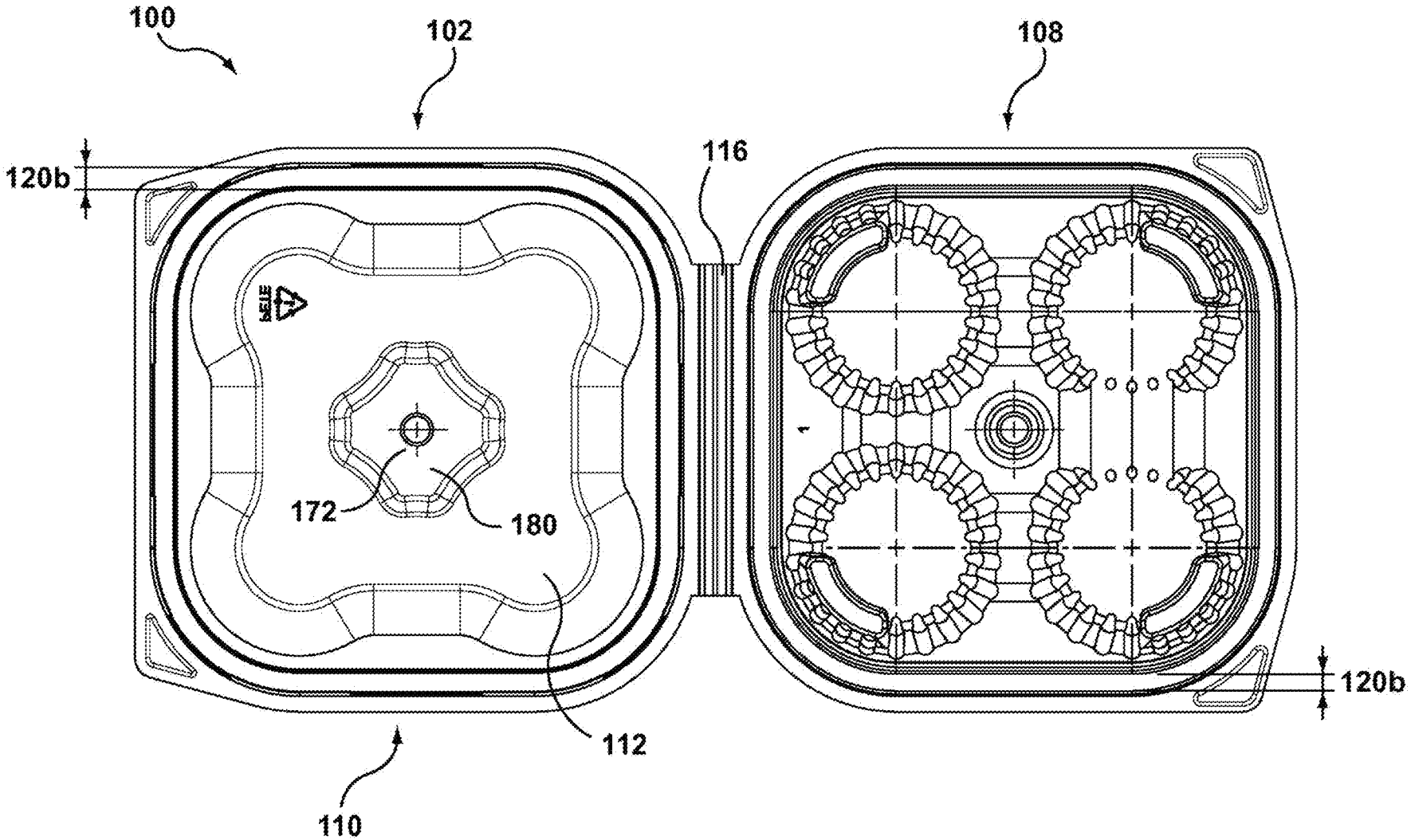
FIG. 2 is a top plan view of the container of FIG. 1.

The container 100 also includes a lid 108 having a lid peripheral edge 110, an upper lid surface 112 (see also FIG. 6) and a lid sidewall 114 extending between the lid peripheral edge and the upper lid surface. The lid 108 is movable between a closed position (FIG. 3), in which the lid peripheral edge 110 is engaged with the base peripheral edge 104 and the upper lid surface 112 covers at least a portion of each cavity 106, and an open position (FIG. 1) in which the lid peripheral edge 110 and base peripheral edge 104 are disengaged to allow access to the interior of the container 100. In the illustrated example, one edge of the lid 108 is connected to the base 102 by an integral hinge 116 (FIG. 2). In this configuration, the lid 108 can pivot relative to the base 102 between the open and closed positions. Alternatively, the lid 108 maybe detachable from the base 102.

Figure 5:
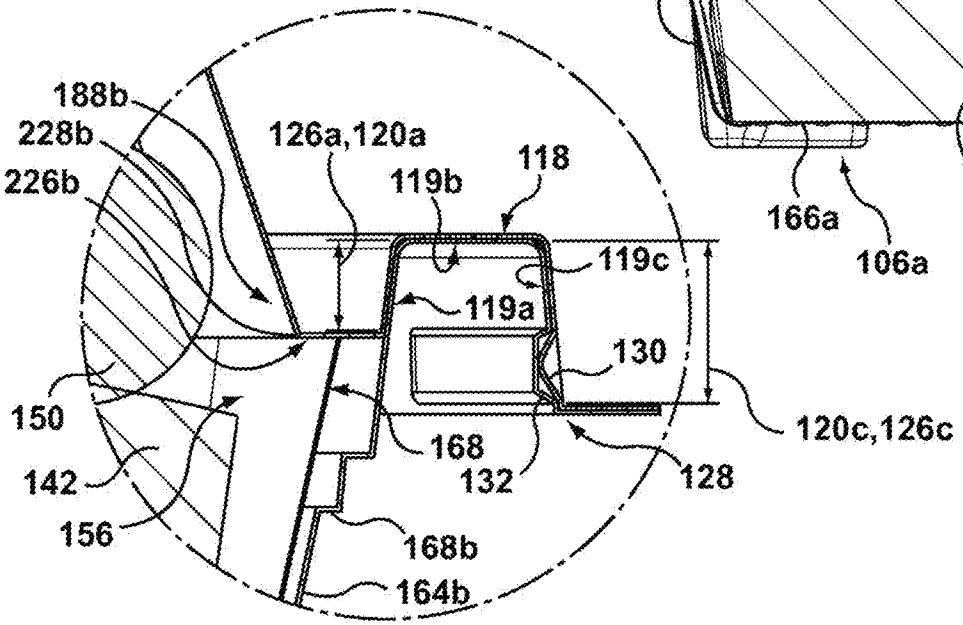
FIG. 5 is an enlarged view of detail area 5 on FIG. 4.

Optionally, when the lid 108 is in the closed position the engagement of the peripheral edges of the base and lid 102, 108, can provide a generally air-tight seal. Providing a seal around the periphery of the container 100 may help keep the cupcakes or other food items fresh while they are stored in the container. Referring to FIG. 1, in the illustrated example, the base 102 includes a base sealing member in the form of an upstanding tongue member 118 that extends around the perimeter of the base 102. Referring to FIG. 5, the tongue member 118 has a generally rectangular cross-sectional shape, and includes a generally inward facing first base sealing surface 119*a*, a generally upward facing second base sealing surface 119*b* and a generally outward facing third base sealing surface 119*c*. Each base sealing surface 119 defines a corresponding surface width 120*a*, 120*b* and 120*c* (see FIGS. 2 and 5). Optionally, the surface widths 120*a-c* may be the same, or alternatively, as in the illustrated example, the tongue 118 may be configured so that the surface widths 120*a-c* are different.

The lid 108 includes a corresponding lid sealing member, which may be any element that is configured to sealingly engage with the base sealing member. Referring to FIG. 1, in the illustrated example, the lid sealing member includes a groove 122 that extends around the perimeter of the lid 108. The groove 122 is sized to snugly and releasably receive the tongue 118 extending from the base 102. Referring to FIG. 5, the groove 122 has a generally rectangular cross-sectional shape that corresponds to the shape of the tongue 118. Alternatively, the tongue 118 and groove 122 may have any suitable, complimentary shapes.

Referring to FIG. 1, in the illustrated example, the groove 122 is bounded by a first lid sealing surface 124*a*, a second lid sealing surface 124*b* and a third lid sealing surface 124*c*, each having respective widths 126*a*, 126*b* and 126*c* (see FIGS. 2 and 5). In the illustrated example, the lid sealing surfaces 124*a-c* are sized to be substantially the same size as their corresponding base sealing surfaces 119*a-c* so that when the lid 108 is closed, the first lid sealing surface 124*a* overlaps and engages the first base sealing surface 119*a*, the second lid sealing surface 124*b* overlaps and engages the second base sealing surface 119*b* and the third lid sealing surface 124*c* overlaps and engages the third base sealing surface 119*c*.

When the lid 108 is closed, an air flow passage is defined between the opposed pairs of sealing surfaces 119*a-c* and 124*a-c*. In the illustrated example, the length of the air flow passage is defined by the sum of the widths 120*a-c* of the base sealing surfaces 119*a-c*. Preferably, the engagement between the tongue 118 and groove 122 (i.e. contact between opposed sealing surfaces 119*a-c* and 124*a-c*) is sufficient to substantially inhibit air flow in and out of the container through the air flow passage to help preserve the freshness of the cupcakes, but is not so tight as to significantly impede opening the container 100. Configuring the tongue 118 and groove 122 to be generally easy to separate from each other may help reduce the amount of force a user must apply to open the container 100, and/or may help lessen the jolt or shock to the container 100 when the lid 108 is opened. This may help reduce the likelihood that cupcakes in the base 102 will be jostled or shaken, potentially damaging their frosting, when the lid 108 is opened.

Figure 3:
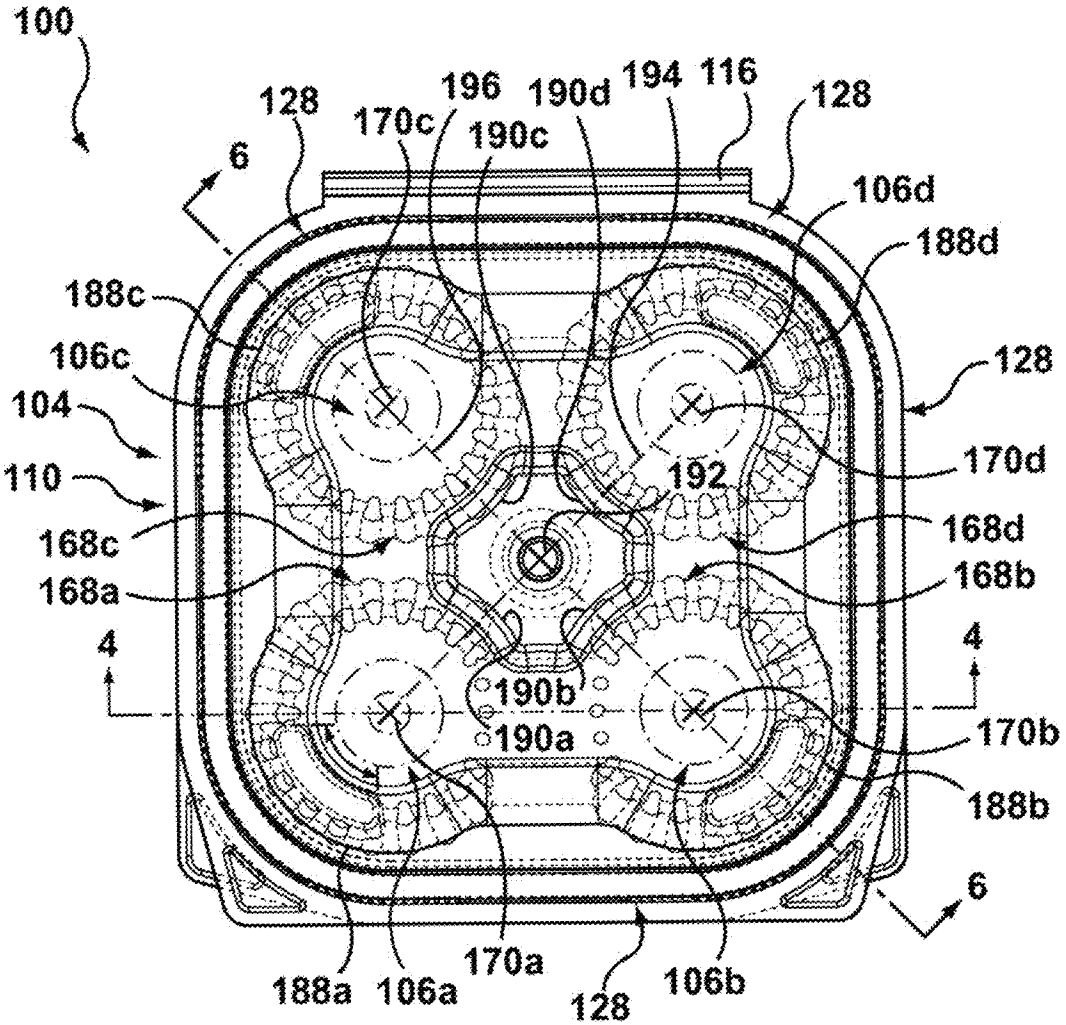
FIG. 3 is a top plan view of the container of FIG. 1 with its lid in a closed position and containing cupcakes.

Optionally, the tongue 118 and groove 122 can be sized so that engagement between the base sealing surfaces 119*a-c* and lid sealing surfaces 124*a-c* provides very little resistance to opening and/or closing the lid 108. In this configuration, the container 100 may include one or more engagement or securement members that may be used to hold the lid in the closed position, without relying on the frictional engagement between the base and lid sealing surfaces 119*a-c* and 124*a-c*. Referring to FIG. 3 In the illustrated example, the container 100 includes a plurality of securement members 128 spaced around the perimeter of the base 102 and the lid 108. Referring to FIG. 1, each securement member includes a first detent member 130 extending inwardly into the groove 122, and a corresponding second detent member 132 provided on the tongue 118. When the lid is closed (FIG. 5), the first detent members 130 are received in the second detent members 132 to help hold the lid 108 in the closed position.

Figure 6:
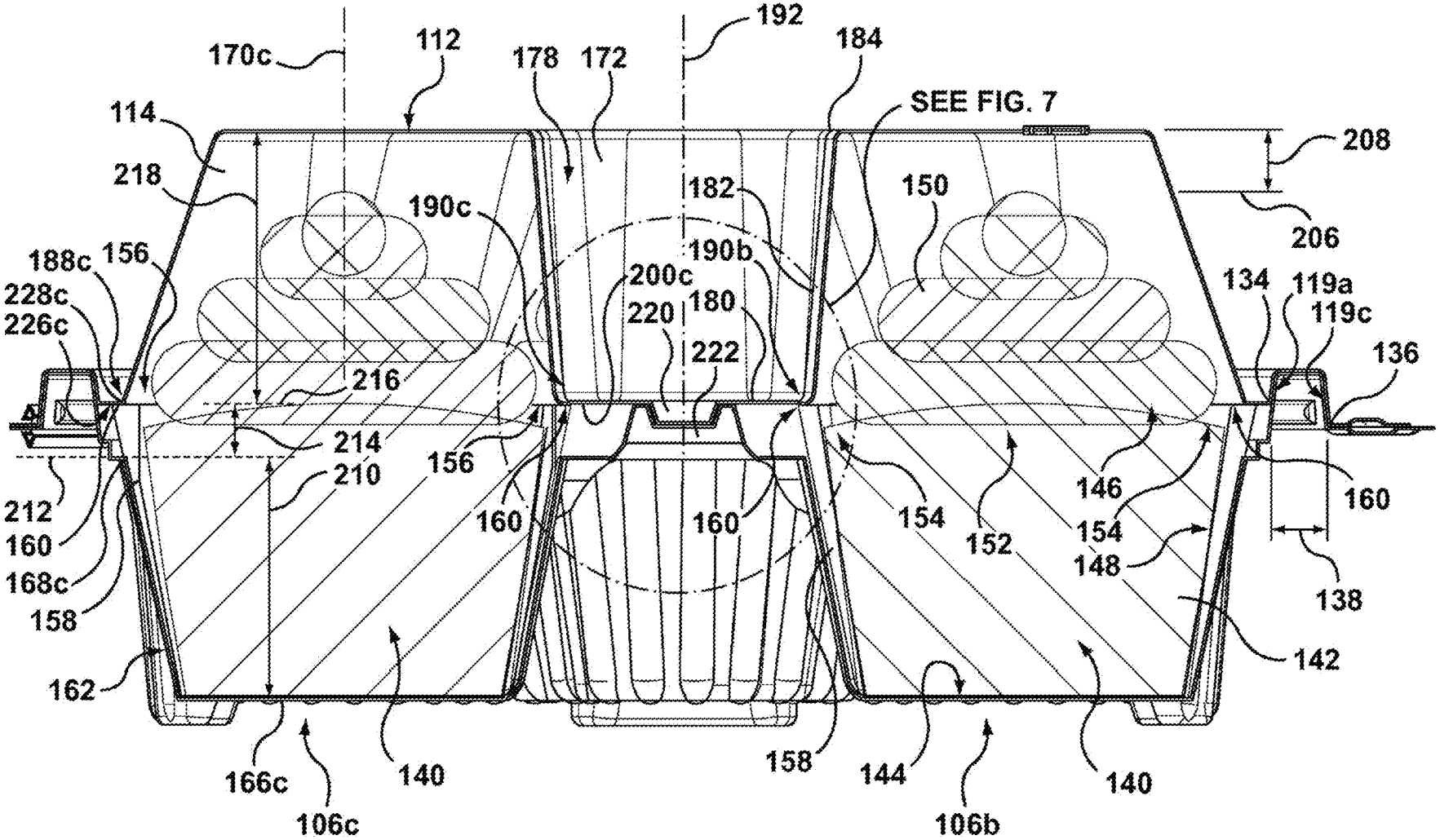
FIG. 6 is a section view of the container of FIG. 3, taken along line 6-6 in FIG. 3.

Referring to FIG. 6, in the illustrated configuration, the inner most edge 134 of the first base sealing surface 119*a* defines an inner seal edge and the outermost edge 136 of the third base sealing surface defines 119*c* an outer seal edge. The inner and outer seal edges 134 and 136 are separated by a lateral seal offset distance 138. The seal offset distance 138 can be any suitable distance, including, for example, between about 3 mm and about 20 mm. In the illustrated example, the seal offset distance 138 is less than length of the air flow passage formed between the mating faces 119*a-c* and 124*a-c* of the tongue 118 and the groove 122, respectively.

Preferably, the lid 108 is at least partially transparent. Providing a transparent lid may allow a user to see into the interior of the container while the lid is closed. In the example illustrated, the lid and base are transparent and are integrally formed as a single, one-piece container.

Figure 4:
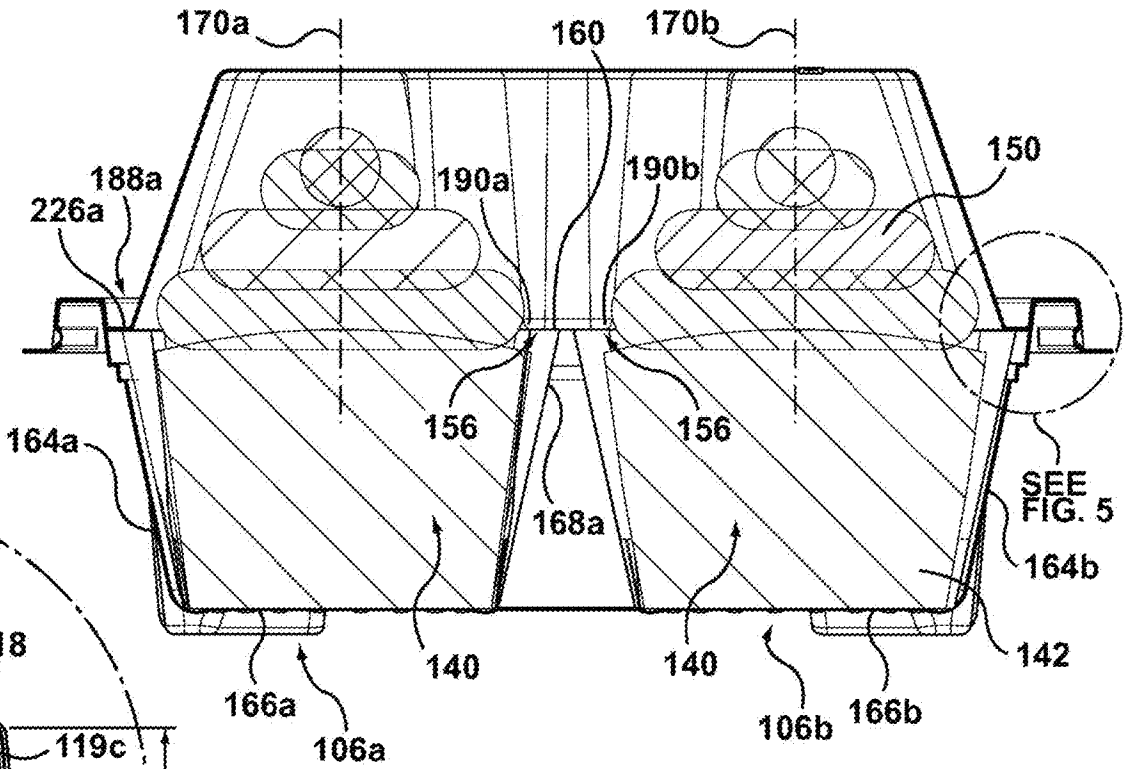
FIG. 4 is a section view of the container of FIG. 3, taken along line 4-4 in FIG. 3.

Referring to FIG. 4, in this illustrated example, the food items positioned in the container 100 are cupcakes 140, but alternatively may be another type of suitable food item. The cavities 106*a-d* in the base are each configured to contain respective ones of the cupcakes 140, with respective ones of the cupcakes 140 nested within respective ones of the cavities.

Referring to FIG. 6, in the illustrated example, each cupcake 140 has a cupcake body portion 142 (generally made of an edible material) contained in a wrapper 158.

In the illustrate example, the body portion 142 of a cupcake 140 has a lower or bottom surface 144, an upper surface 146 and an outer or side surface 148 extending from the lower body surface 144 to the upper body surface 146. The body portion 142 may include a baked cake, or cake-like food product. Alternatively, the body portion 142 may be formed by another type of edible food product.

Optionally, some or all of the upper body surface 146 of the cupcake body 142 portion can be decorated, for example using another edible food product, such as icing or frosting 150. In some configurations, substantially the entire upper body surface 146 of the body portion 142 may be covered in frosting 150. Alternatively, the frosting 150 may be limited to only a portion of the upper body surface 146, providing a decorated section 152 and a corresponding undecorated section 154 of the upper body surface 146. If the frosting 150 is generally centered relative to the body portion 142, the undecorated portions 154 of the upper body surface 146 may form part of (or optionally all of) an undecorated peripheral section 156 of the cupcake 140 that generally surrounds the central, decorated section 152 of the upper body surface 146.

In some instances, the frosting 150 will be relatively soft and fragile, and may be prone to deformation or other damage if it comes into contact with another object or surface. Such damage to the frosting 150 may make the decorated cupcake 140 less visually appealing or otherwise interfere with the aesthetic presentation of the cupcake, or other such decorated food item. When transporting such decorated food items (for example from a production facility to a retail store), it may be desirable to reduce the likelihood that the decorated section of the food item, e.g. the frosted section, will be damaged during transport.

Optionally, the body portion of a food item can be wrapped or otherwise covered by a non-edible (i.e. a non-food product) wrapper or sleeve. The wrapper can be removable from the body portion of the food item so that a user may separate the wrapper from the food item prior to consuming the food item.

The wrapper may cover the bottom surface and some or all of the side surfaces of the body portion, but may leave substantially the entire upper body surface exposed for decorating. In this configuration, the wrapper may terminate in an upper wrapper edge that generally surrounds the upper surface of the food item body portion. If the food item is decorated, the decoration (e.g. frosting) may be limited to the upper body surface of the body portion, and may not be applied to cover the upper wrapper edge. In this configuration, the upper wrapper edge may form at least part of the undecorated peripheral section of the food item. If the frosting does not cover the entire upper body surface, the undecorated portions of the upper body surface (for example portions 154 of cupcake 140) may also form part of the undecorated peripheral section (for example section 156 in FIG. 6) of the assembled food item. That is, the undecorated periphery or perimeter of a frosted cupcake (or other such food item) may include a combination of edible and inedible material (e.g. the undecorated portions of the edible body portion upper surface and the upper wrapper edge).

One example of a suitable wrapper is a paper "cup"-type wrapper commonly used in the preparation and baking of cupcakes. Such paper wrappers can be placed in a cupcake baking pan and then filled with cupcake batter. The wrappers can be corrugated, smooth or have any other suitable configuration. When the cupcake bodies are baked, the batter is transformed into a cake product and bonds to the paper wrapper. Alternatively, the wrapper need not be paper, and may be formed from any suitable material, including, for example, metal, plastic, silicone and other materials. Preferably, the material of the wrapper is selected to be generally food safe, such that it will not contaminate the food product contained therein. The wrapper may be bonded to the food item during the cooking or preparation process, as described above, or may be attached to an already-prepared food item body portion. The wrapper may be a single-use wrapper that is intended to be disposed after it is separated from the body portion (e.g. a paper wrapper) or may be a re-useable wrapper that is intended to be re-filled with edible food products.

Referring to FIG. 6, in the illustrated example the cupcakes 140 include paper wrappers 158. Each wrapper 158 covers the bottom surfaces 144 and the side surfaces 148 of the body portion 142 of a respective cupcake 140, but leaves the upper body surface 146 exposed for decorating. In this configuration, the wrapper 158 terminates at an upper wrapper edge 160 that generally surrounds the upper body surface 146 of the cupcake body portion 142. The upper edge 160 of the paper wrapper 158 forms a generally continuous perimeter around the exposed, upper body surface 146. In this configuration, the wrapper is sized so that the upper wrapper edge 160 extends slightly above the upper body surface 146 in the vertical direction (as illustrated).

In the illustrated example, the wrapper 158 is located between the side surface 148 of the cupcake body 142 and an inner surface 162 of its respective cavity 106. In the illustrated example, the upper wrapper edge 160 and upper body surface 146 each form part of an upper surface of the cupcake 140. Alternatively, the upper wrapper edge 160 may be positioned only part way up the side surface 146 of the body portion 142.

Referring again to FIG. 6, in the illustrated example, an undecorated portion 154 of the upper body surface 146 surrounds the decorated central section 152, and the frosting 150 does not cover the upper wrapper edge 160. In this configuration, the undecorated portions 154 of the cupcake upper body surface 146 and the upper wrapper edge 162 cooperate to define the undecorated peripheral section 156 of the cupcake 140. Alternatively, the frosting 150 may extend to the edges of the upper body surface 146 and the undecorated peripheral section 156 of the cupcake 140 may only include the upper wrapper edge 160. In the illustrated example, the wrapper 158 is removable from the body portion 142 prior to consumption of the cupcake 140.

Each cupcake 140 has an outer surface, which contacts and is supported by an inner surface 162 of its respective cavity. In the illustrated example the outer surface of the cupcake 140 that is supported by the inner surface 162 of the cavity 106 is the outer surface the wrapper 158. Alternatively, it can be the side surface 148 and bottom surface 144 of the body portion 142 of the cupcake 140 (or the surfaces of any other type of food item that is not contained in a removable, inedible wrapper).

Referring to FIG. 1, optionally, the inner surfaces 162*a-d* of the cavities 106*a-d* can be shaped to closely correspond to the shape of the food items that are to be placed in the cavities. Shaping the cavities to match the contour of the food items may further assist in providing a snug fit of the food items within the cavities so that lateral movement of the food items relative to the base is inhibited. Referring to FIG. 4, in the illustrated example the inner surface includes the surface of a generally frusto-conical cavity sidewall 164 and a cavity bottom wall 166. Each cavity sidewall 164*a-d* extends upward along a respective cavity axis 170*a-d* from the cavity bottom wall 166 and generally terminates in a respective cavity rim 168*a-d*, located at the open, upper end of the cavity 106*a-d* (see also FIG. 3).

Referring to FIG. 3, in the illustrated example, the container 100 includes four cavities 106*a-d* arranged in a 2×2 matrix configuration. Optionally, in other configurations, the container can include fewer than four cavities (e.g. between 1-3 cavities) or more than four cavities, and the cavities can be arranged in a plurality of different configurations. For example, the container can be configured to have a different number of cavities, for example, 1, 2, 6, 8, 9, 10, 12, 16, 18 and 24 cavity containers, and the cavities can be arranged in a plurality of different configurations, including, for example 1×2, 2×3, 2×4, 3×3, 2×5, 3×4, 4×4, 3×6, 3×8 and 4×6 configurations.

To help limit axial or vertical movement between the cupcakes 140 within their respective cavities 106*a-d* the container 100 includes one or more retainers for engaging the cupcakes when the lid 108 is closed. Optionally, the container 100 can be configured to include at least one retainer, and preferably two or more retainers, to engage each cupcake 140 in the container 100. The retainers can be provided on the lid 108 so that closing the lid moves the retainers into a desired retaining position. The retainers can be provided at any suitable location(s) on the lid 108, including for example extending inwardly from the lid sidewall 114 and/or being provided on one or more internal protrusions or other such features provided on the lid 108, as described below. Optionally, the retainers may be integrally formed with the lid 108, or alternatively, may be separate members connected to the lid 108 in desired locations.

Referring to FIG. 1, in the illustrated example the container 100 includes a protrusion 172 extending downwardly from the upper lid surface 112, when the lid 108 is in the closed position. The protrusion 172 has a distal end 174 that is spaced apart from the upper lid surface 112. Referring to FIG. 6, in the illustrated example, the protrusion 172 includes a generally hollow interior 178 that is bounded by a protrusion lower end wall 180 and a protrusion sidewall 182 that extends from the upper lid surface 112 to the protrusion lower end wall 180. The upper end of the protrusion side wall 182 terminates at an aperture 184 in the upper lid surface 112, and the upper end of the protrusion 172 is open providing access to the hollow interior 178 of the protrusion 172. The lid aperture 184 and protrusion interior 178 can be of any desirable size and shape that is compatible with a given base portion 102 and given baked goods. Optionally, the aperture 184 and hollow interior 178 can function as a grip member and can be sized to accommodate insertion of a thumb or finger(s) of a user grasping the container 100. Providing such a grip member may help a user grasp the container 100 using a single hand when the lid 108 is closed. Configuring the container to help facilitate single-handed manipulation may make it easier for a user to grasp or carry. Providing a grip member may also help reduce the amount of downward compression a user must apply to the upper lid surface 112 to firmly or securely grasp the container. Reducing the amount of downward compression on the upper lid surface 112 may help reduce the inward deflection of the upper lid surface 112 and may help prevent the upper lid surface 112 from being deflected inwardly and contacting the frosting 150 when the container is being grasped or manipulated.

In the illustrated example the protrusion 172 is integral with the upper lid surface 112. In other examples, the protrusion 172 may be a separate member that is affixed to the upper lid surface 112.

Referring to FIG. 3, in the example illustrated, when the lid 108 is in the closed position the protrusion 172 extends downward from the upper lid surface 112 toward the base 102 at a location on the base 102 that is positioned generally laterally between the first, second, third and fourth cavities 106*a-d*.

Referring to FIG. 1, the container 100 also includes a plurality of retainers that are configured to help retain the cupcakes within their respective cavities, and to inhibit vertical movement of the cupcakes relative to the base when the lid is in the closed position. In the illustrated example, the container includes a plurality of retainers 188*a-d* associated with the sidewall 114 of the lid 108 (sidewall retainers), and a plurality of retainers 190*a-d* positioned toward the distal end 174 of the protrusion 172 (protrusion retainers). In the illustrated example, each cavity 106*a-d* is provided with one sidewall retainer 188 and one protrusion retainer 190. In the following description, each retainer is identified using a two part naming system that identifies both the feature on which the retainer is formed, and the cavity into which the retainer extends. For example, the term "protrusion first retainer" identifies the retainer that is affixed to the distal end of the protrusion and interacts with the first cavity. Similarly, the term "sidewall second retainer" identifies the retainer that is affixed to the lid sidewall and interacts with the second cavity. One retainer is described in detail below, and the features and functions described may be common to all of the retainers 188*a-d* and 190*a-d*.

In the illustrated example, the protrusion includes a protrusion first retainer 190*a* that is adjacent the distal end 174 of the protrusion 172. When the lid 108 is in the closed position the protrusion first retainer 190*a* is positioned proximate the first cavity 106*a* to engage the cupcake 140 nested therein. Referring to FIG. 4, in the illustrated configuration, when the lid is closed the protrusion first retainer 190*a* overlies the undecorated marginal or peripheral section 156 of the cupcake 140 in the first cavity 106*a*. In the illustrated example, the cupcake 140 and retainer 190*a* are sized and configured so that the undecorated peripheral section 156 of the cupcake 140 that is engaged by the protrusion first retainer 190*a* is generally limited to the upper wrapper edge 160 of the wrapper 158, and the protrusion first retainer 190*a* does not extend over or contact the upper body surface 146 of the body portion 142 of the cupcake 140.

Configuring the protrusion first retainer 190*a* to contact substantially only the upper wrapper edge 160, instead of contacting portions of the edible body portion 142, may help prevent the edible body portion 142 from being squeezed or otherwise damaged by contacting the protrusion first retainer 190*a*. This may help preserve the quality and aesthetic appearance of the cupcakes 140.

For some food products, the preparation of the edible body portion may result in body portions of slightly different sizes and shapes. For example, baking a plurality of cupcake bodies may produce body portions having upper body surfaces that are slightly different from each other. Such variations may affect the height or position of the upper body surface relative to the cavity when the body portions are placed in the container. For some food items, the inedible wrappers may have generally more consistent dimension and/or physical properties than the edible body portions contained therein.

In the illustrated example, the paper wrappers 158 used to surround the cupcakes may be substantially identical. Due to the consistency between multiple wrappers 158, when a wrapped cupcake is placed in its cavity, the position of the upper wrapper edge 160 relative to the protrusion first retainer 190*a* may be more uniform or consistent, from cupcake to cupcake, than the position of the upper body surface 146 relative to the protrusion first retainer 190*a*. Configuring the protrusion first retainer 190*a* to engage the upper wrapper edge 160, instead of the edible upper body surface 146, may allow for tighter tolerances on the design of the protrusion first retainer 190*a* and the positioning of the protrusion first retainer 190*a* relative to the expected position of the upper wrapper edge 160.

In some configurations the wrappers 158 may tend to be more rigid and/or durable than the edible body portions. Positioning the retainers to engage the generally more rigid upper wrapper edge 160, instead of or in addition to engaging a portion of the upper body surface 146, may help reduce uncertainty regarding the potential deflection or deformation of the food item when it contacts the retainers. Sufficiently high deflection or deformation of the food item may reduce the effectiveness of the retainers at retaining the food items within their cavities 160*a-d*, and/or may result in the food item pivoting about the cavity relative to the cavity axis. Pivoting of the food items may allow the decorated portions (i.e. the frosting 150) to contact the lid sidewall 114 or other portions of the container 100 which may damage the decorated section of the food item even if the decorated section does not contact the upper lid surface 112.

In the illustrated example, the container 100 is configured so that the first protrusion retainer 190*a* extends laterally inwardly of the first cavity rim 168*a* and overlies a portion of the interior of the first cavity 106*a*. Alternatively, for example if the undecorated peripheral section 156 of the cupcake extends sufficiently laterally beyond of the cavity rim 168, the protrusion first retainer 190*a* (and any other retainers provided in proximity to the first cavity 106*a*) need not extend laterally inboard of the cavity rim 168*a* in order to overlie the undecorated peripheral section 156 and retain the cupcake 140 within the first cavity 106*a*.

Referring to FIG. 4, the protrusion also includes a protrusion second retainer 190*b*, which is also affixed to the protrusion 172 adjacent the distal end 174 thereof. When the lid 108 is in the closed position the protrusion second retainer 190*b* is positioned proximate the second cavity 106*b* to engage the cupcake 140 nested within the second cavity 106*b*, and overlies the undecorated marginal or peripheral section 156 of the cupcake 140 in the second cavity 106*b*. Optionally, as explained above, the protrusion second retainer 190*b* may extend laterally inwardly of the second cavity rim 168*b* and may overlie a portion of the second cavity 106*b*. In this configuration, when the lid 108 is closed and the container is inverted, axial movement of the cupcakes 140 relative to the cavities 106*a* and 106*b* can be limited by contact between the retainers 190*a* and 190*b* and the undecorated sections 156 of the cupcakes 140.

Referring also to FIG. 3, in the example illustrated, the protrusion 172 also includes a protrusion third retainer 190*c* which, when the lid 108 is closed, is proximate the third cavity 106*c*, overlies the undecorated marginal or peripheral section of the cupcake in the third cavity 106*c* and, in the illustrated example, extends laterally inwardly of the third cavity rim 168*c*. The protrusion 172 further includes, in the example illustrated, a protrusion fourth retainer 190*d* which, when the lid 108 is closed, is proximate the fourth cavity 106*d*, overlies the undecorated marginal or peripheral section of the cupcake in the fourth cavity 106*d* and, in the illustrated example, extends laterally inwardly of the fourth cavity rim 168*d*.

The protrusion retainers 190*a-d* may help retain the cupcakes 140 within their corresponding cavities 106*a-d* when the container 100 is inverted, tilted, shaken or jostled in a vertical direction, for example when the container 100 is being transported.

Referring to FIG. 6, in the illustrated example, the protrusion 172 extends lengthwise along a protrusion axis 192. Referring also to FIG. 3, in the illustrated example, each of the cavity axes 170*a-d* and the protrusion axis 192 are generally parallel to, and laterally offset from each other when the lid 108 is closed, and the protrusion axis 192 is laterally spaced between two or more of the plurality of cavity axes 170*a-d*.

In the illustrated example, when the lid 108 is in the closed position, the protrusion 172 is generally centered laterally between the first, second, third and fourth cavities 106*a-d* and the protrusion axis 192 is generally equidistant from the first, second, third and fourth cavity axes 170*a-d*. In the example illustrated, the four cavities 106*a-d* are arranged in a 2×2 matrix with the axes 170*a-d* of the cavities positioned relative to each other to form the corners of a generally square shape when viewed in plan view (FIG. 3).

In the illustrated configuration, the protrusion axis 192 is positioned generally coincident with the intersection of two diagonals or planes 194 and 196, each diagonal connecting together a pair of cavity axes at opposite corners of the square pattern (e.g. plane 194 contains axes 170*a* and 170*d*, and plane 196 contains axes 170*b* and 170*c*). When illustrated in plan view, as shown in FIG. 3, the planes 194 and 196 are represented by diagonal lines extending between pairs of cavity axes.

In the illustrated example, the retainers have generally the same configuration, and analogous features can be provided on each retainer. Therefore, the detailed description of the protrusion third retainer, included below, is understood to apply to each of the retainers and the relationship between the retainers and their corresponding food items and cavities.

Referring again to FIG. 7, the protrusion third retainer 190*c* includes an upright surface 198*c* and a generally planar abutment surface 200*c*. The intersection of the upright surface 198*c* and the abutment surface 200*c* defines a retainer edge 202*c*. In this configuration, the abutment surface 200*c* extends generally radially between the retaining edge 202*c* and the protrusion axis 192.

Optionally, the shape of the retaining edge 202*c* can be selected to generally match the shape of the cavity rim 168*c*. Referring to FIG. 1, in the illustrated example, the cavity rim 168*c* is generally circular, centered about the cavity axis 170*c* and has a desired radius of curvature. The retaining edge 202*c* is also arcuate and is shaped to generally correspond to the radius of curvature of the cavity rim 168*c*. Alternatively, the shape of the retaining edge 202*c* need not correspond to the shape of the cavity rim 168*c*.

The arc length 204*c* of the retaining edge 202*c* can be selected so that the retaining edge 202*c*, and associated abutment surface 200*c*, can overlie a desired segment of the cavity rim 168*c* and/or a desired length the undecorated peripheral section 156 of the cupcake 140 in the third cavity 106*c* (e.g. the upper wrapper edge 160 in the illustrated example). For example, the arc length 204*c* of the retaining edge 202*c* can be between about 1% and about 50% of the circumference (or length) of the cavity rim 168*c* and/or of perimeter length of the upper wrapper edge 160, and optionally can be between about 5% and about 35%, or greater than 50%, of the cavity rim 168*c* length or upper wrapper edge 160 length. The arc length of the sidewall retainers 188*a-d*, for example arc length 206*c* of sidewall retainer 188*c*, may be the same as the length of the protrusion retainers 190*a-d*, or, as illustrated may be greater than the lengths of the protrusion retainers 190*a-d*. In the illustrated example, arc length 206*c* is greater than arc length 204*c*, and may be between about 1% and about 65% of the length of the cavity rim 168*c* and/or of the upper wrapper edge 160.

Figure 7:
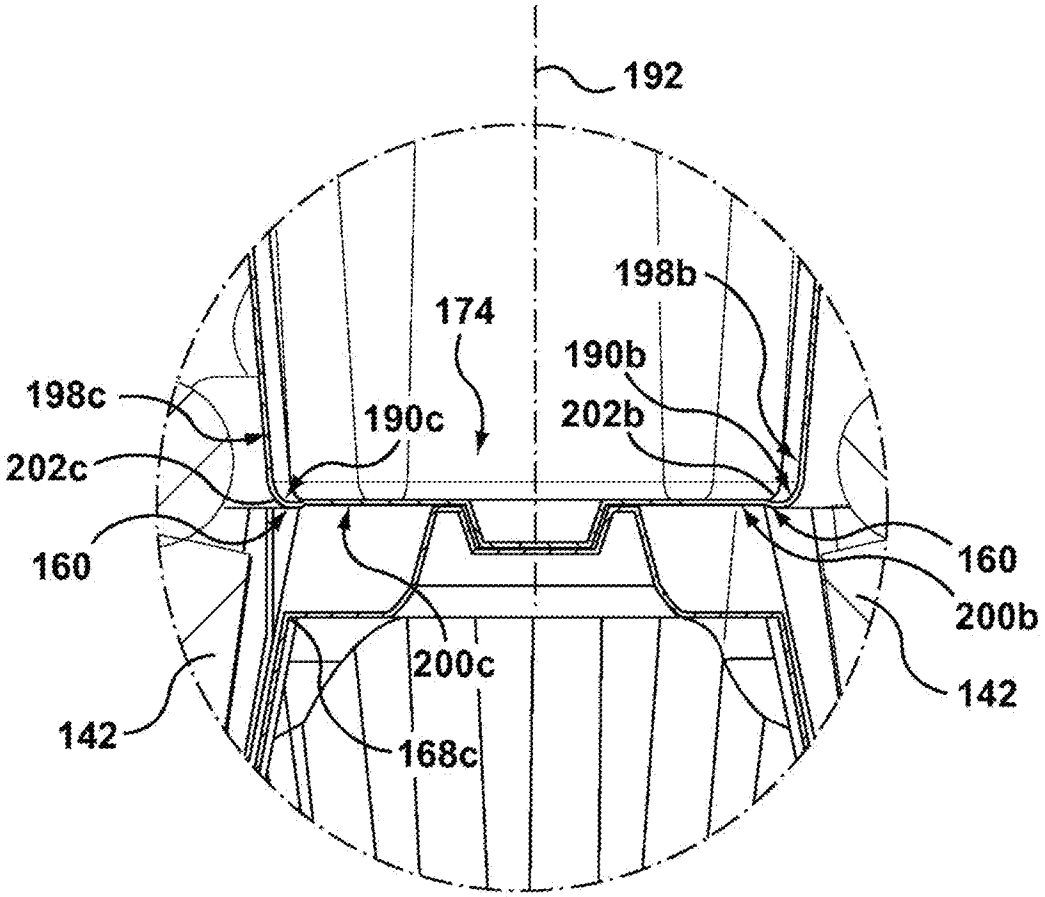
FIG. 7 is an enlarged view of the detail area 7 on FIG. 6.

Referring to FIG. 7, when the lid 108 is closed, the abutment surface 200*c* is generally downward facing and is generally parallel to a plane that contains the cavity rim 168*c*.

In the illustrated example, the container is configured so that the abutment surface 200*c* bears against the undecorated peripheral portion 156 of the cupcake 140 (in this example the upper wrapper edge 160) in the third cavity 106*c*.

Alternatively, the retainers, including the protrusion third retainer 190*c*, can be positioned so that when the container 100 is upright and the lid is closed the retainers are adjacent to, but not in contact with, the undecorated peripheral section 156 of the cupcake 140, and will only come into contact with the upper wrapper edge 160 when the container 100 is tilted or inverted. In this configuration, when the lid 108 is closed the abutment surface, for example surface 200*c*, would remain spaced apart from the upper wrapper edge 160 by a generally vertical retainer spacing distance (see for example distance 3207 in FIG. 13*a*). This may help reduce the risk that the protrusion third retainer 190*c* will compress, crush or otherwise damage portions of the cupcake 140 when the lid is closed. This may also help the container accommodate slight variations in cupcake size, wrapper height, container dimensional tolerances, cupcake placement irregularities, without requiring adjustment or repositioning of the first protrusion retainer. In this configuration, when the lid 108 is closed and the container is inverted, the cupcake 140 may be allowed to shift axially relative to its cavity until it has moved so that its upper wrapper edge 160 contacts the corresponding abutment surface. The amount of axial cupcake travel may generally correspond to the vertical retainer spacing distance.

Preferably, the retainer spacing distance (not shown) is less than the axial spacing 208 between a plane 206 (FIG. 6) containing the upper most portions of the frosting 150 and the upper lid surface 112. Configuring the container 100 so that the retainer offset distance is less than the decoration spacing distance 208 may help ensure that the cupcake 140 does not move far enough in the axial direction to allow the frosting 150 to contact the inside of the upper lid surface 112. Optionally, the retainer spacing distance when the lid is closed and the container is upright may be any suitable distance, including for example, between about 0 mm to about 15 mm and between about 1 mm to about 5 mm or greater than 15 mm.

Referring to FIG. 6, the third cavity 106*c* has a cavity depth 210 measured from the plane 212 containing cavity rim 168*c* to the cavity bottom wall 166*c* in the direction the cavity axis 170*c*. When the lid 108 is in the closed position there may be a longitudinal distance 214 between a plane 216 containing the abutment surface 200*c* and the plane 212. The longitudinal distance 214 can be less than about 15% of the cavity depth 210, between about 15% to about 25% of the cavity depth 210, and optionally can be greater than 25% of the cavity depth 210.

The protrusion 172 has a protrusion height 218 measured axially from the upper lid surface 112 to plane 216. The protrusion height 218 can be selected based on the size of the food item that is to be held in the container. Preferably, the protrusion height 218 is at least equal to the height of the frosting 150 on the cupcake 140. This may help prevent the upper lid surface 112 from contacting the frosting 150 when the lid is closed. Optionally, the protrusion height 218 can be greater than the height of the frosting by an amount selected to provide a desired decoration spacing distance 208.

Referring to FIG. 1, optionally, the protrusion 172 can include a protrusion engagement member 220 that is provided on the distal end 174 of the protrusion 172 and is configured to mate with a corresponding base engagement member 222 when the lid is closed. In the illustrated example, the protrusion engagement member 220 is a boss that can fit, and optionally snap-fit, into a corresponding recess 222 on the base. Optionally, providing a snap-fit between the boss 220 and the recess 222 may help secure the lid 108 in the closed position. Optionally, the protrusion and base engagement members 220, 222 can also be configured to serve as locating or alignment members. For example, as the lid 108 is closing, contact between a generally curved boss 220 and the recess 222 may help urge the protrusion 172 toward its desired lateral position, and may help ensure that the distal end 174 of the protrusion 172 is properly located between the cavities 106*a-d* while the lid is closed. Providing cooperating locating members on the protrusion 172 and the base 102 may help prevent the distal end 174 of the protrusion 172 from becoming misaligned and intruding into one of the cavities 106*a-d*, potentially damaging a cupcake.

The sidewall retainers 188*a-d* are configured to operate in a manner analogous to the protrusion retainers 190*a-d* described above, and include analogous features. In the illustrated example, when the lid 108 is in the closed position each sidewall retainer 188*a-d* is positioned proximate a respective cavity 106*a-d* and overlies a portion of the undecorated peripheral sections 156 of the cupcakes 140 contained therein. Optionally, the sidewall retainers 188*a-d* can extend laterally inwardly of their corresponding cavity rims 168*a-d*.

In the illustrated example, the sidewall retainer and the protrusion retainer for a given cavity, for example the protrusion third retainer 190*c* and the sidewall third retainer 188*c*, can co-operate to help retain the cupcake within the cavity 106*c*. The sidewall and protrusion retainers can be structurally the same or similar, or can be structurally different. In the illustrated example, each sidewall retainer comprises a sidewall retainer abutment surface 226 and a sidewall retainer retaining edge 228, which are analogous to the abutment surface 200*c* and retaining edge 202*c* described above.

Optionally, the container 100 can be of one-piece, integrally formed unitary construction including the base 102, lid 108, the protrusion 172 extending downwardly from the upper lid surface 112, the protrusion retainers 190*a-d*, the sidewall retainers 188*a-d* and the hinge 116 that pivotably connects the lid 108 and the base 102. Alternatively, the lid 108 and base 102 can be separately formed members and can be connected together using a hinge or another suitable, openable or releasable connection mechanism.

Figure 8:
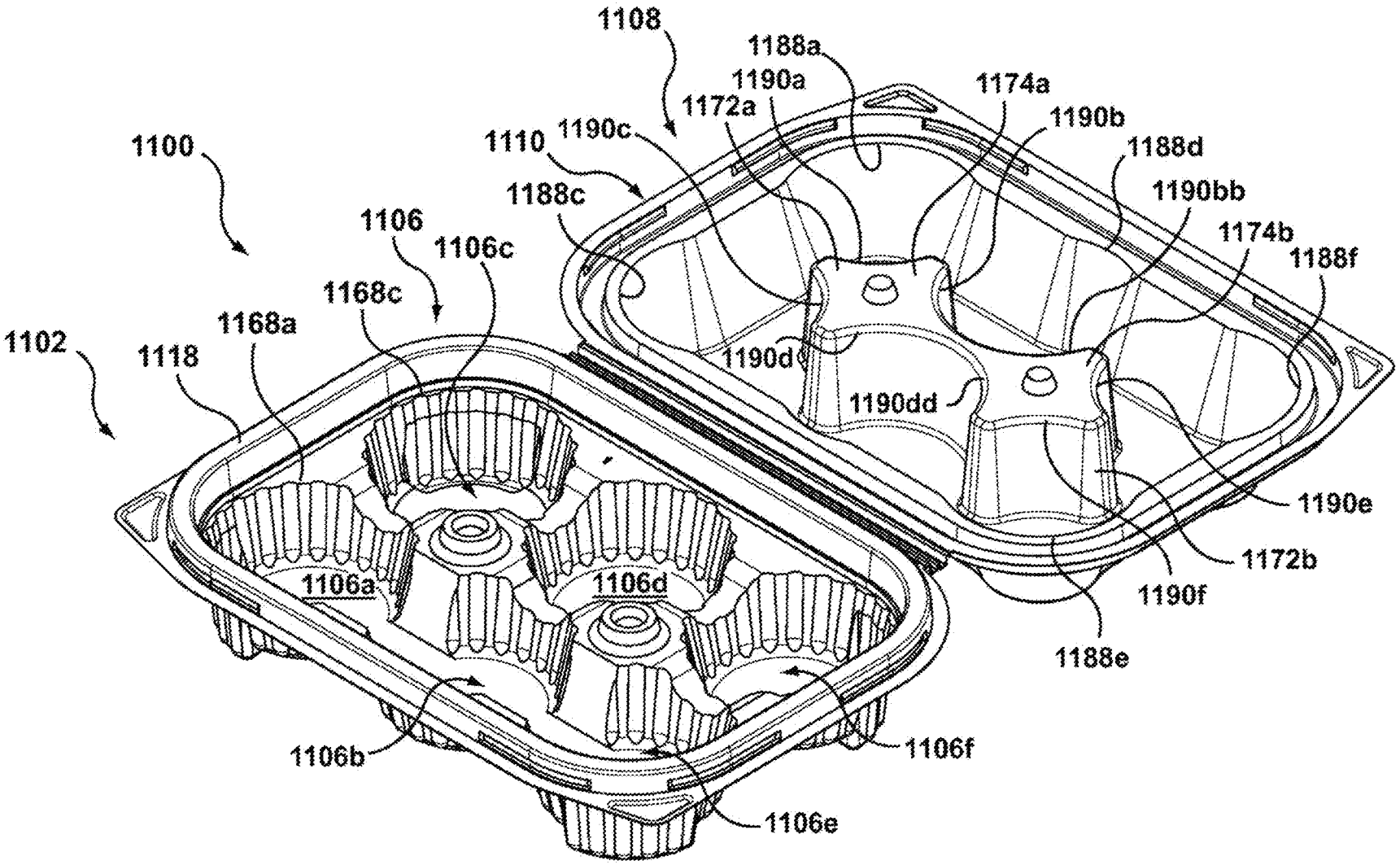
FIG. 8 is a perspective view of another embodiment of a container, with its lid in an open position.

Referring to FIG. 8, another example of a container 1100 in accordance with aspects of the applicant's teaching is described, having a base with six cavities 1106*a-f* (referred to as a six-pack container). The six-pack container 1100 has similar features to the four-pack container 100, and similar features are identified by like reference characters, incremented by 1000.

The base 1102 of the six-pack container includes a first cavity 1106*a* having a first cavity rim 1168*a*, a second cavity 1106*b* having a second cavity rim 1168*b*, a third cavity 1106*c* having a third cavity rim 1168*c*, a fourth cavity 1106*d* having a fourth cavity rim 1168*d*, a fifth cavity 1106*e* having a fifth cavity rim 1168*e* and a sixth cavity 1106*f* having a sixth cavity rim 1186*f*. The six cavities 1106*a-f* are arranged in a 2×3 matrix configuration.

Figure 9:
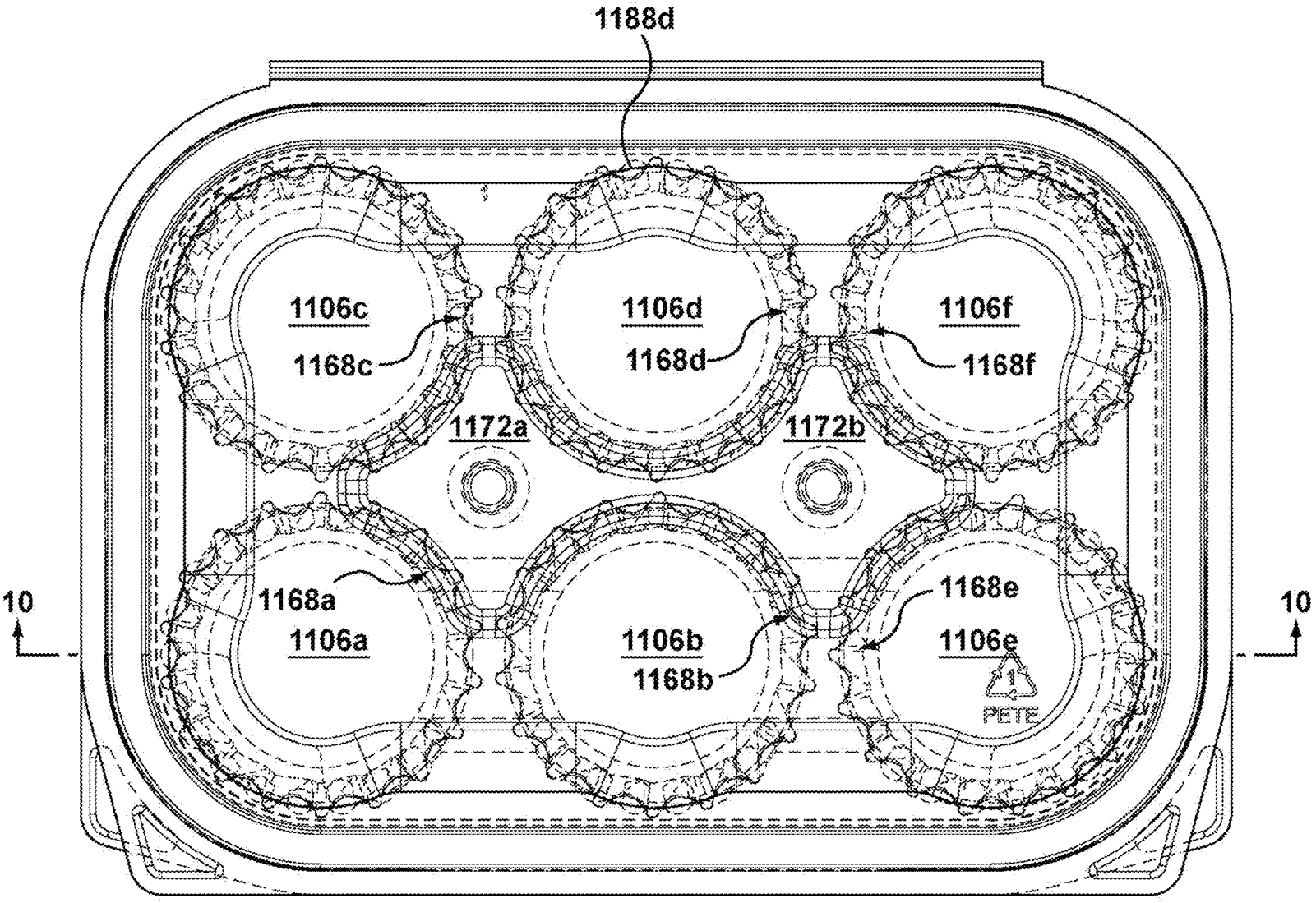
FIG. 9 is a top plan view of the container of FIG. 7, with its lid in a closed position.
Figure 10:
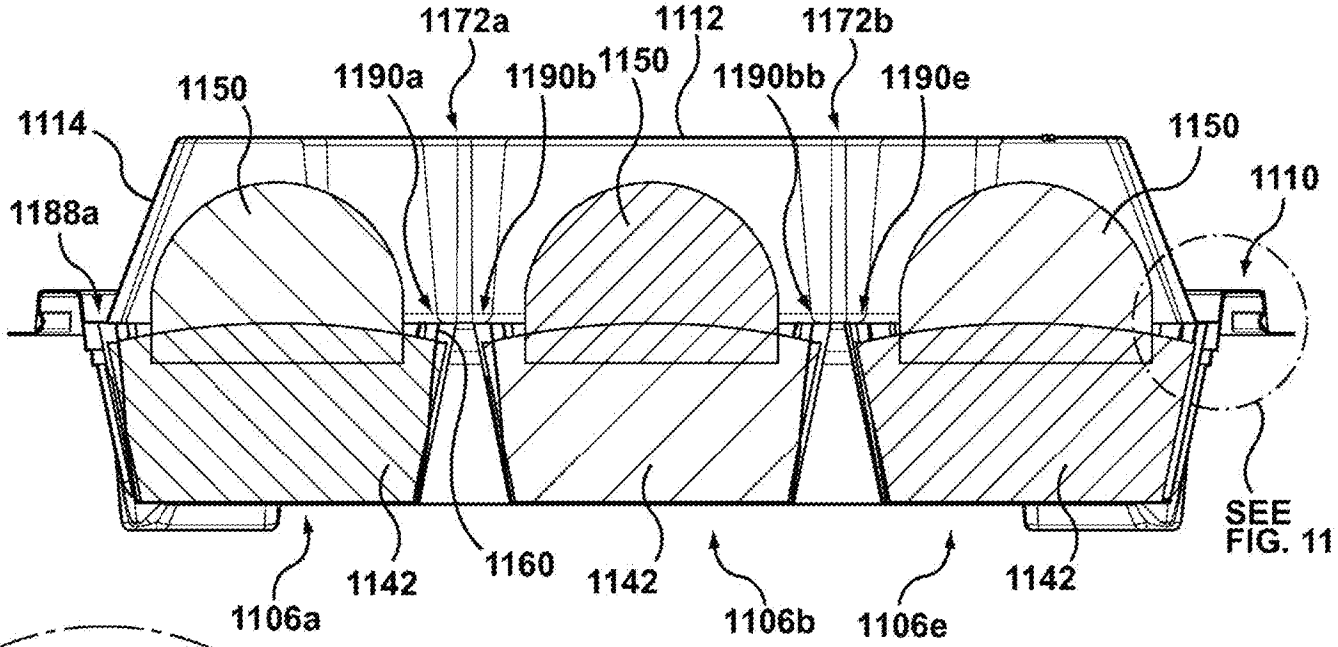
FIG. 10 is a section view of the container of FIG. 8, taken along line 10-10 in FIG. 9.
Figure 11:
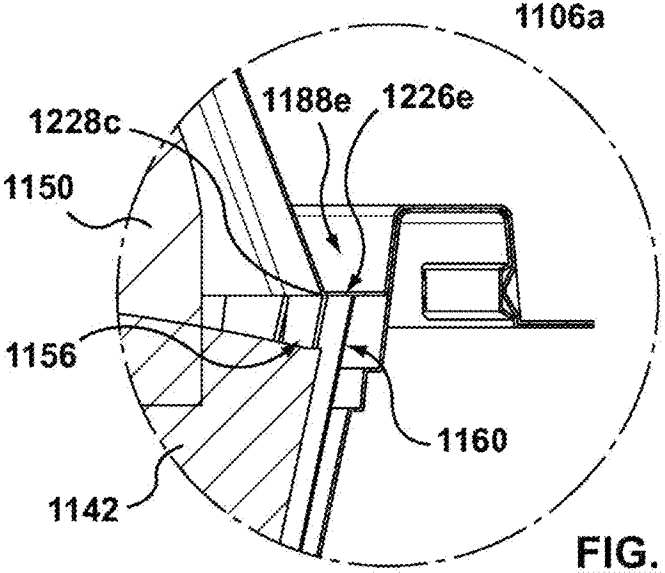
FIG. 11 is an enlarged view of detail region 11, on FIG. 10.

The container 1100 includes a lid 1108 hingedly connected to the base 1102, and the lid 1108 is moveable between a closed position (FIG. 9) and an open position (FIG. 8). The lid 1108 includes a lid peripheral edge 1110, a lid sidewall 1114, a lid upper surface 1112 and two retaining protrusions 1172*a* and 1172*b* extending from the lid upper surface 1112. Protrusions 1172*a* and 1172*b* may be generally identical and can include analogous features. In the example illustrated, the first and second protrusions 1172*a* and 1172*b* are connected to each other. Alternatively, the first and second protrusions 1172*a* and 1172*b* can be discrete members.

Like the container 100 described above, the six-pack container 1100 includes a plurality of retainers to help vertically secure food items, such as cupcakes, within their respective cavities. The plurality of retainers can include a plurality of protrusion retainers and a plurality of sidewall retainers.

Referring to FIG. 8, a plurality of protrusion retainers 1190 can be provided on the distal ends 1174*a* and 1174*b* of each of the first and second protrusions 1172*a* and 1172*b*. In the illustrated example, the first and second protrusions 1172*a* and 1172*b* each include four protrusion retainers. The first protrusion 1172*a* includes a first protrusion first retainer 1190*a*, a first protrusion second retainer 1190*b*, a first protrusion third retainer 1190*c* and a first protrusion fourth retainer 1190*d*. The second protrusion 1172*b* includes a second protrusion second retainer 1190*bb* (i.e. a retainer 1190 that is located on the second protrusion 1172*b* and that is associated with the second cavity 1106*b*), a second protrusion fourth retainer 1190*dd*, a second protrusion fifth retainer 1190*e* and a second protrusion sixth retainer 1190*f*. Each protrusion retainer 1190 has a respective retainer edge 1202 and abutment surface 1200.

In this configuration, some of the cavities, for example the second and fourth cavities 1106*a* and 1106*d* are invaded by retainers on more than one protrusion. When the lid 1108 is closed, both the first protrusion second retainer 1190*b* and the second protrusion second retainer 1190*bb* can engage a cupcake within the second cavity 1106*b* to help inhibit vertical movement of the cupcake 1140. Like cupcakes 140, the cupcakes 1140 each include a body 1142 and are topped with frosting 1150. Similarly, both the first protrusion fourth retainer 1190*d* and the second protrusion fourth retainer 1190*dd* can cooperate to help retain a cupcake in the fourth cavity 1106*d*.

Referring to FIG. 8, optionally, two or more of the protrusion retainers can be connected together to form a generally continuous retaining member, having a generally continuous retaining edge. For example, in the illustrated example, the first protrusion second retainer 1190*b* and the second protrusion second retainer 1190*bb* are joined together to form a generally continuous retaining edge that extends approximately half way around the second cavity rim 1168*b* (i.e. has a length that is between about 35% and about 60% or approximately about 50% of the second cavity rim length). In this configuration, the total length of the protrusion retaining edges that can act to retain a cupcake in the second cavity (i.e. the sum of the lengths of the first protrusion second retaining edge and the second protrusion second retaining edge) can be greater than the length of the retaining edge(s) associated within another one of the cavities, for example the first protrusion first retaining edge.

Optionally the lid 1108 can be configured to include a sidewall first retainer 1188*a*, a sidewall second retainer 1188*b*, a sidewall third retainer 1188*c*, a sidewall fourth retainer 1188*d*, a sidewall fifth retainer 1188*e* and a sidewall sixth retainer 1188*f*. In this example, the lid comprises one sidewall retainer for each of the six cavities 1106*a-f*. In the illustrated example, the sidewall retainers positioned toward the middle of the container, 1188*b* and 1188*d*, are smaller than sidewall retainers provided toward the corners of the container 188*a*, 1188*c*, 1188*e*, and 1188*f*. However, in the illustrated example the protrusion retainers positioned toward the middle of the container, 1190*b* and 1190*bb*, and 1190*d* and 1190*dd* are longer (when taken together) than the protrusion retainers 1190*a*, 1190*c*, 1190*e* and 1190*f*. Optionally, the retainers can be sized so that the total length of the retainers associated with each cavity may be approximately equal, or within about 25% of each other. For example the retainer length of the combination of 1190*a* and 1188*a* acting on the first cavity 1106*a* may be approximately the same as the length of the combination of 1188*b*, 1190*b* and 1190*bb* acting on the second cavity 1106*b*.

Optionally, the number of cavities can be different than the number of sidewall retainers.

Referring to FIG. 12, another example of a container 2100 in accordance with aspects of the applicant's teaching is described, having a base with nine cavities 2106*a*-I (referred to as a nine-pack container). The nine-pack container 2100 has similar features to the four-pack container, and similar features are identified by like reference characters, incremented by 2000.

The nine-pack container 2100 includes nine cavities 2106*a-i* arranged in a 3×3 configuration. Each cavity has a corresponding cavity rim and cavity sidewall, as described above.

The 9-pack 2100 container also includes a first protrusion 2172*a*, a second protrusion 2172*b*, a third protrusion 2172*c* and a fourth protrusion 2172*d* extending from the lid upper surface 2112.

The 9-pack 2100 container includes a plurality of retainers 2188 and 2190 to secure cupcakes within the nine cavities 2106*a-i*. The plurality of retainers includes a plurality of protrusion retainers 2190.

The distal ends of the four protrusions 2172*a-d* each comprise four protrusion retainers. Each protrusion retainer 2190 is configured to retain a respective cupcake in its cavity. For example, the first protrusion includes a first protrusion first retainer 2190*a*, a first protrusion second retainer 2190*b*, a first protrusion third retainer 2190*c* and a first protrusion fourth retainer 2190*d*, for retaining cupcakes in the first, second, third and fourth cavities 2106*a-d*, respectively. As explained above, some or all of the four protrusions 2172*a-d* can optionally be connected to each other, as illustrated.

Similarly, the fourth protrusion 2172*d* comprises a fourth protrusion fourth retainer 2190*dddd*, a fourth protrusion sixth retainer 2190*ff*, a fourth protrusion eighth retainer 2190*h* and a fourth protrusion ninth retainer 2190*i* for engaging cupcakes in the fourth, sixth, eighth and ninth cavities 2106*d*, 2106*f*, 2106*h* and 2106*i*, respectively.

In the illustrated example, the fourth cavity 2106*d* is an inboard cavity, which is not adjacent to any portion of the lid sidewall. In this configuration, the fourth cavity 2190 is engaged by four protrusion retainers (the first protrusion fourth retainer 2190*d*, the second retainer fourth protrusion 2190*dd*, the third retainer fourth protrusion 2190*ddd* and the fourth retainer fourth protrusion 2190*dddd*) and is not engaged by any sidewall retainers. Optionally, the first, second, third and fourth protrusion fourth retainers 2190*d-dddd* can be interconnected to each other to provide a generally continuous, circular retaining edge that overlaps substantially the entire upper wrapper edge 2160 of the cupcake contained in the fourth cavity 2106*d*.

Referring to FIG. 13, another example of a container 3100 in accordance with aspects of the applicant's teaching is described, having a base with one cavity (referred to as a single container). The single container 3100 has similar features to the four-pack container, and similar features are identified by like reference characters, incremented by 3000.

Container 3100 includes a base 3102, containing a single cavity 3106 and a lid 3108 hingedly connected to the base 3102. In this configuration, the lid includes a first sidewall retainer 3188*a*, a second sidewall retainer 3188*a*, a third sidewall retainer 3188*aaa* and a fourth sidewall retainer 3188*aaaa*. Each retainer 3188*a-aaaa* extends laterally inwardly from the lid sidewall 3114, and when the lid 3108 is closed, is positioned to overlie a respective portion of the undecorated peripheral section of the cupcake 3140 in the cavity 3106. In this example, the lid 3108 does not include a protrusion extending inwardly from the upper lid surface 3112. Instead, all of the retainers 3188 for engaging the cupcake 3140 are provided on the lid sidewall 3114.

Referring to FIG. 13*a*, optionally, the retainers 3188 can be sized so that the retainer edges 3228, and portions of the abutment surfaces 3226, extend laterally inboard of the cavity rim 3168 and are positioned laterally intermediate the cavity rim 3168 and the cavity axis 3170 and overlie the upper wrapper edge 3160 and undecorated portions 3154 of the upper body surface 3146. In this configuration the undecorated peripheral section 3156 that can be engaged by the retainers 3188 includes both the upper wrapper edge 3160 and at least some of the undecorated portions 3154 of the upper body surface 3146. In the illustrated example, the wrapper 3158 is sized so that when the lid 3108 is closed and the container is upright the upper wrapper edge 3160 are spaced apart from the abutment surfaces 3226 of the sidewall retainers 3188 by the retainer spacing distance 3207. The retainer spacing distance 3207 can be any suitable distance, and preferably is selected to be less than the decoration spacing distance 3208.

In the illustrated example, a label 3240 is affixed to the outside of the container 3100 and is connected to both the base 3102 and the lid 3108. The label 3240 can be adhered such that it is difficult to remove without tearing so that a user will tear the label 3240 when opening the lid 3108. This may serve as a tamper-evident feature, alerting a subsequent user to the fact that the container 3100 has been previously opened.

Referring to FIG. 15, a method 1500 of providing packaged food articles for display in a retail store begins at step 1502 with the preparation of a plurality of food body portions of respective food articles in a preparation facility. At step 1504, each body portion is decorated with a decoration portion on an upper surface of the food base portion.

After steps 1502 and 1504, at step 1506 the decorated food items are loaded into respective cavities of a container. The container has a plurality of retainers for securing the food items, and may have any of the features described herein. Optionally the container may include a lid with at least one protrusion having at least a first retainer and a second retainer extending laterally outwardly from a distal end of the protrusion.

After step 1506, at step 1508 the lid is closed to move the retainers into position in which they overlie respective portions of the undecorated peripheral sections of their respective food items. first retainer to engage a first marginal portion of a first upper surface of a first food item in the container and moves the second retainer to engage a second marginal portion of a second upper surface of a second food item in the container.

After step the lid is closed, step 1510 includes transporting the container away from the preparation facility for indirect or direct delivery to the retail store.

Optionally, at step 1512, the decorated food items can be frozen prior to delivery to the retail store.

At step 1514, the container can be placed for display on a sales shelf in the retail store.

Optionally, before step 1514 the food items can be thawed at step 1516.

What has been described above has been intended to be illustrative of the invention and non-limiting. Modifications may be made without departing from the scope of the invention as defined in the claims appended hereto.

The invention claimed is:

1. A method of providing packaged food items on display in a retail store, comprising:

a) preparing a plurality of edible body portions of respective food items in a preparation facility, the plurality of edible body portions including a first edible body portion of a first food item and a second edible body portion of a second food item;

b) after step (a), loading the first and second food items into respective first and second cavities of a container, the container having a lid with a substantially planar upper lid surface covering the cavities when the lid is closed and at least one protrusion extending downward from the upper lid surface, the protrusion having at least a first retainer and a second retainer extending laterally outwardly from a distal end of the protrusion;

c) after step (a), decorating the first edible body portion with a first edible decorating product applied to a first decoration portion on a first upper surface of the first edible body portion and leaving a first marginal portion of the first upper surface adjacent the first decoration portion free of decoration, and decorating the second edible body portion with a second edible decorating product applied to a second decoration portion on a second upper surface of the second edible body portion and leaving a second marginal portion of the second upper surface adjacent the second decoration portion free of decoration;

d) after step (c), closing the lid, wherein closing the lid moves the first retainer to abut the first marginal portion of the first upper surface of the first edible body portion of the first food item in the container, and moves the second retainer to abut the second marginal portion of the upper surface of the second edible body portion of the second food item in the container, wherein closing the lid moves the first and second retainers to respective positions protruding laterally inwardly of respective first and second cavity rims at upper ends of the first and second cavities; and e) after step (d), placing the container for display on a sales shelf in the retail store.

2. The method of claim 1, further comprising after steps (a) and (b), and before step (d), freezing the food items.

3. The method of claim 2, further comprising, before said placing step and after said freezing step, thawing the food items.

4. The method of claim 1, wherein the preparing step (a) comprises dispensing batter into a plurality of wrappers disposed on a baking pan, and baking the batter to form the edible body portions of baked batter, wherein each of the first upper surface and the second upper surface is formed by a top surface of the baked batter in a respective wrapper, each top surface extending across an upper end of the respective edible body portion, and wherein each edible body portion has a side surface of baked batter extending downward from the upper surface, at least a portion of the side surface of each edible body portion having the respective wrapper removably bonded thereto.

5. The method of claim 4, wherein the loading step (b) comprises removing the edible body portions from the baking pan.

6. A method of packaging decorated food items in a visually appealing manner, comprising:

a) nesting first, second, third, and fourth food items in respective first, second, third, and fourth cavities in a base of a container, the cavities arranged in a two-by-two pattern, each food item including a respective edible body portion having an upper surface directed away from the base;

b) prior to at least step c), providing a decorated section on the upper surface of the edible body portion of each of the first, second, third, and fourth food items by applying an edible decorating product thereon, each decorated section at least partially bounded by an undecorated marginal portion of the upper surface of the edible body portion of each respective food item; and c) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for abutting respective locations along the undecorated marginal portions of the edible body portions of the first, second, third, and fourth food items, respectively, to limit displacement of the food items out of the cavities; and d) wherein the closing step moves the first, second, third, and fourth protrusion retainers to respective positions protruding laterally inwardly of respective first, second, third, and fourth cavity rims at upper ends of the first, second, third, and fourth cavities.

7. The method of claim 6, wherein the upper lid surface, the lid sidewall, and the retaining protrusion are integrally formed of a transparent plastic material.

8. The method of claim 6, wherein the first, second, third and fourth protrusion retainers abut the respective locations of the undecorated marginal portions of the edible body portions of the first, second, third, and fourth food items generally constantly when the food items are in the cavities and the lid is closed, to inhibit the decorated sections from contacting an inner surface of the lid.

9. The method of claim 6, wherein the first, second, third, and fourth protrusion retainers abut the respective portions of the undecorated marginal portions of the first, second, third, and fourth food items only when the food items are urged upwards towards the closed lid during handling of the container, to inhibit the decorated sections from contacting an inner surface of the lid.

10. A method of packaging decorated food items in a visually appealing manner, comprising:

a) nesting first, second, third, and fourth food items in respective first, second, third, and fourth cavities in a base of a container, the cavities arranged in a two-by-two pattern, each food item including an edible body portion having an upper surface directed away from the base;

b) prior to at least step c), providing a decorated section on the upper surface of the edible body portion of each food item by applying an edible decorating product thereon, each decorated section at least partially bounded by an undecorated marginal portion of the respective edible body portion; and c) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for abutting respective locations of the undecorated marginal portions of the first, second, third, and fourth food items, respectively, to limit displacement of the food items out of the cavities; and d) wherein the closing step moves the first, second, third, and fourth retainers to respective positions protruding laterally inwardly of respective first, second, third, and fourth cavity rims at upper ends of the first, second, third, and fourth cavities.

11. The method of claim 10, wherein the lid, including the upper lid surface, the lid sidewall, and the retaining protrusion, and the base, including the cavities and the cavity rims, are integrally formed of a transparent plastic material, the lid and base connected to each other by a living hinge, and wherein closing the lid onto the base comprises pivoting the lid about the living hinge.

12. A method of packaging decorated food items, comprising:

a) nesting first, second, third, and fourth food items in respective first, second, third, and fourth cavities in a base of a container, the cavities arranged in a two-by-two pattern, each food item including an edible body portion with an upper surface, the upper surface including a decorated section at least partially bounded by an undecorated marginal portion of the upper surface of the edible body portion; and b) closing a lid onto the base, the lid having a lid peripheral edge and a substantially planar upper lid surface connected about a perimeter thereof to the lid peripheral edge by a lid sidewall, and the lid having a retaining protrusion extending downwardly from the upper lid surface when the lid is in the closed position, the retaining protrusion including first, second, third, and fourth protrusion retainers for overlying respective locations of the undecorated marginal portions of the upper surface of the edible body portions of the first, second, third, and fourth food items, respectively, to limit displacement of the food items out of the cavities; and c) wherein the closing step moves the first, second, third, and fourth protrusion retainers to respective positions protruding laterally inwardly of respective first, second, third, and fourth cavity rims at upper ends of the first, second, third, and fourth cavities.

13. The method of claim 12, wherein when nested in the respective cavities, and with the lid closed, a gap of limited vertical extent is provided between the respective protrusion retainers and the respective locations of the undecorated marginal portions of the upper surfaces of the edible body portions of the respective food items so that the displacement of the food items out of the cavities is limited to about the vertical extent of the gap.

14. The method of claim 12, wherein an outer side surface of the edible body portion of each food item is wrapped at least in part by a paper wrapper.

15. The method of claim 12, further comprising prior to step a), preparing the first, second, third, and fourth food items by dispensing batter in first, second, third, and fourth removable wrappers disposed on a baking pan, and then baking the batter to form the edible body portions of baked batter, wherein the upper surface of the edible body portion of each food item is formed by a top surface of the baked batter in each respective wrapper.

16. The method of claim 15, wherein the undecorated marginal portion of the upper surface of the edible body portion of each food item includes an undecorated surface portion of the top surface of the baked batter of the respective food item.

17. The method of claim 15, wherein each respective edible body portion of each food item has a side surface of baked batter extending downward from the top surface, and wherein each wrapper has a wrapper inner surface removably bonded to a portion of the side surface of each respective body portion.

18. The method of claim 17, wherein each wrapper has a wrapper outer surface opposite the wrapper inner surface, each wrapper outer surface bearing against a cavity inner surface of the respective cavity and freely slidable axially relative to the cavity inner surface when each respective food item is nested in the respective cavity to facilitate removal of the food item from the container by a consumer.

19. The method of claim 18, wherein the step of closing the lid:

a) moves the first protrusion retainer into a first retaining position abutting a first undecorated surface portion of a first top surface of the baked batter of the first food item; and b) moves the second protrusion retainer into a second retaining position abutting a second undecorated surface portion of a second top surface of the baked batter of the second food item; and c) moves the third protrusion retainer into a third retaining position abutting a third undecorated surface portion of a third top surface of the baked batter of the third food item; and d) moves the fourth protrusion retainer into a fourth retaining position abutting a fourth undecorated surface portion of a fourth top surface of the baked batter of the fourth food item.

20. The method of claim 19, wherein:

a) axial movement of the first food item in a direction from the nested position toward the lid is limited by contact of the first protrusion retainer with the first undecorated surface portion of the baked batter of the first food item;

b) axial movement of the second food item in a direction from the nested position toward the lid is limited by contact of the second protrusion retainer with the second undecorated surface portion of the baked batter of the second food item;

c) axial movement of the third food item in a direction from the nested position toward the lid is limited by contact of the third protrusion retainer with the third undecorated surface portion of the baked batter of the third food item; and d) axial movement of the fourth food item in a direction from the nested position toward the lid is limited by contact of the fourth protrusion retainer with the fourth undecorated surface portion of the baked batter of the fourth food item.

* * * * *